US008713863B2

(12) United States Patent
Moller, Jr. et al.

(10) Patent No.: US 8,713,863 B2
(45) **Date of Patent: *May 6, 2014**

(54) MODULAR FLOOR TILE WITH RESILIENT SUPPORT MEMBERS

(71) Applicant: SnapSports Company, Salt Lake City, UT (US)

(72) Inventors: Jorgen J. Moller, Jr., Salt Lake City, UT (US); Jeremiah D. Shapiro, Herriman, UT (US)

(73) Assignee: Snapsports Company, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/784,673

(22) Filed: Mar. 4, 2013

(65) Prior Publication Data

US 2013/0180195 A1 Jul. 18, 2013

Related U.S. Application Data

(60) Continuation of application No. 12/945,195, filed on Nov. 12, 2010, now Pat. No. 8,656,662, which is a division of application No. 12/252,168, filed on Oct. 15, 2008, now Pat. No. 8,099,915, which is a continuation-in-part of application No. 11/379,109, filed on Apr. 18, 2006, now Pat. No. 7,587,865, which is a continuation-in-part of application No. 11/291,002, filed on Nov. 30, 2005, now Pat. No. 7,958,681, which is a continuation-in-part of application No. 11/143,337, filed on Jun. 2, 2005, now Pat. No. 7,571,572.

(51) Int. Cl.
*E04F 15/02* (2006.01)

(52) U.S. Cl.
USPC ..... 52/181; 52/177; 52/403.1

(58) Field of Classification Search
USPC ..... 52/177, 180, 181, 386, 403.1, 512
See application file for complete search history.

(56) References Cited

U.S. PATENT DOCUMENTS

| | | | |
|---|---|---|---|
| 738,704 | A | 9/1903 | Semmer |
| 841,998 | A | 1/1907 | Mulford |

(Continued)

FOREIGN PATENT DOCUMENTS

| | | |
|---|---|---|
| DE | 3545969 | 9/1986 |
| GB | 2262437 | 6/1993 |
| JP | 02236355 | 9/1990 |

OTHER PUBLICATIONS

Athletic Business, advertisement for Flexideck, p. 81; advertisement for Sports Floor, p. 53; advertisement for Basic Coatings Sports, p. 43; Mar. 2001.

(Continued)

*Primary Examiner* — Adriana Figueroa
(74) *Attorney, Agent, or Firm* — Holland & Hart

(57) ABSTRACT

Modular floor tiles and modular floors are described herein. A modular floor tile may include a top surface layer, a plurality of edge surfaces, an interlocking mechanism for attachment to adjacent tiles, and a support system. The support system may additionally include a first rigid level and at least one resilient support member disposed under the top surface layer, the at least one resilient support member extending to a distance further from the top surface layer than the first rigid level. The at least one resilient support member may be compressible toward the top surface layer. A modular floor may include a plurality of interlocking tiles connected to one another. A method of forming a modular floor that includes an interlocking modular tile is also disclosed.

25 Claims, 14 Drawing Sheets

(56) References Cited

U.S. PATENT DOCUMENTS

| | | | | | |
|---|---|---|---|---|---|
| 884,493 | A | | 4/1908 | Kahn | |
| 1,328,875 | A | | 1/1920 | Herbert | |
| 1,420,775 | A | | 6/1922 | Stanwood | |
| 1,625,187 | A | | 4/1927 | Birch | |
| 1,722,139 | A | | 7/1929 | Galassi | |
| 1,765,652 | A | | 6/1930 | Burgess | |
| D93,991 | S | | 12/1934 | Moore | |
| 2,853,854 | A | | 9/1958 | Burton et al. | |
| 3,015,136 | A | | 1/1962 | Doe | |
| 3,093,870 | A | | 6/1963 | Brock | |
| 3,196,763 | A | | 7/1965 | Rushton | |
| 3,279,138 | A | | 10/1966 | Dittmar | |
| 3,284,819 | A | | 11/1966 | Nissen | |
| 3,289,375 | A | | 12/1966 | Cline | |
| 3,319,392 | A | | 5/1967 | Fitzgerald | |
| 3,438,312 | A | | 4/1969 | Becker et al. | |
| 3,452,497 | A | | 7/1969 | Warp | |
| 3,717,247 | A | | 2/1973 | Moore | |
| 3,721,460 | A | | 3/1973 | Holman et al. | |
| 3,741,411 | A | | 6/1973 | Peacock | |
| 3,861,592 | A | | 1/1975 | Fisher | |
| 3,909,996 | A | * | 10/1975 | Ettlinger et al. | 52/177 |
| 4,008,548 | A | | 2/1977 | Leclerc | |
| 4,051,987 | A | | 10/1977 | Scribner | |
| 4,054,987 | A | | 10/1977 | Forlenza | |
| 4,133,481 | A | | 1/1979 | Bennett | |
| 4,211,366 | A | | 7/1980 | Czarnota | |
| 4,226,060 | A | | 10/1980 | Sato | |
| 4,287,693 | A | | 9/1981 | Collette | |
| 4,296,160 | A | * | 10/1981 | Forlenza | 428/117 |
| 4,436,779 | A | | 3/1984 | Menconi et al. | |
| 4,440,818 | A | | 4/1984 | Buchan et al. | |
| 4,543,765 | A | | 10/1985 | Barrett | |
| 4,584,221 | A | | 4/1986 | Kung | |
| 4,606,156 | A | | 8/1986 | Sweers et al. | |
| 4,715,743 | A | | 12/1987 | Schmanski | |
| 4,826,351 | A | | 5/1989 | Haberhauer et al. | |
| 4,860,510 | A | | 8/1989 | Kotler | |
| 4,879,857 | A | | 11/1989 | Peterson et al. | |
| 4,917,532 | A | | 4/1990 | Haberhauer et al. | |
| 4,930,286 | A | | 6/1990 | Kotler | |
| 5,014,488 | A | | 5/1991 | Evangelos et al. | |
| 5,033,241 | A | | 7/1991 | Max | |
| 5,220,785 | A | | 6/1993 | Miller | |
| 5,275,502 | A | | 1/1994 | Glaza | |
| 5,277,010 | A | | 1/1994 | Stephenson et al. | |
| 5,323,575 | A | | 6/1994 | Yeh | |
| 5,364,204 | A | * | 11/1994 | MacLeod | 404/35 |
| 5,403,637 | A | | 4/1995 | Pickard et al. | |
| 5,433,070 | A | | 7/1995 | Amelio | |
| 5,492,069 | A | | 2/1996 | Alexander et al. | |
| 5,509,244 | A | * | 4/1996 | Bentzon | 52/387 |
| 5,527,128 | A | | 6/1996 | Rope et al. | |
| 5,587,218 | A | | 12/1996 | Betz | |
| 5,628,160 | A | | 5/1997 | Kung | |
| D383,253 | S | | 9/1997 | Semenuk | |
| D385,974 | S | | 11/1997 | Berger | |
| D385,978 | S | | 11/1997 | Berger | |
| 5,749,787 | A | | 5/1998 | Jank | |
| 5,761,867 | A | * | 6/1998 | Carling | 52/386 |
| 5,787,654 | A | | 8/1998 | Drost | |
| 5,807,021 | A | | 9/1998 | Aaron | |
| 5,815,995 | A | | 10/1998 | Adam | |
| 5,833,386 | A | | 11/1998 | Rosan et al. | |
| 5,904,021 | A | | 5/1999 | Fisher | |
| 5,950,378 | A | | 9/1999 | Council | |
| 5,992,106 | A | | 11/1999 | Carling et al. | |
| 6,061,979 | A | | 5/2000 | Johannes | |
| 6,089,784 | A | | 7/2000 | Ardern | |
| 6,098,354 | A | | 8/2000 | Skandis | |
| D456,533 | S | | 4/2002 | Moller, Jr. | |
| D462,792 | S | | 9/2002 | Ogawa | |
| 6,467,224 | B1 | | 10/2002 | Bertolini | |
| 6,526,705 | B1 | | 3/2003 | MacDonald | |
| D481,470 | S | | 10/2003 | Moller, Jr. | |
| 6,751,912 | B2 | | 6/2004 | Stegner et al. | |
| 6,802,159 | B1 | | 10/2004 | Kotler | |
| 6,878,430 | B2 | | 4/2005 | Milewski et al. | |
| D516,737 | S | | 3/2006 | Moller, Jr. | |
| 7,114,298 | B2 | | 10/2006 | Kotler | |
| 7,211,314 | B2 | | 5/2007 | Nevison | |
| 7,303,800 | B2 | | 12/2007 | Rogers | |
| 7,331,147 | B2 | | 2/2008 | Kalisiak et al. | |
| 7,575,795 | B2 | | 8/2009 | Scott et al. | |
| 7,748,177 | B2 | * | 7/2010 | Jenkins et al. | 52/177 |
| 7,849,642 | B2 | | 12/2010 | Forster et al. | |
| 2006/0265975 | A1 | | 11/2006 | Geffe | |
| 2007/0044412 | A1 | | 3/2007 | Forster et al. | |

OTHER PUBLICATIONS

Athletic Business, advertisement for Hid-N-Lok School Color Series tiles; advertisement for Fitness Flooring, p. 29; advertisement for Mitchell Rubber Products, p. 30; advertisement for Loktuff, p. 34; advertisement for Dri-Dek, p. 74; advertisement for Tepromark, p. 77; advertisement for Haro Sports, p. 100; advertisement for Plexipave, p. 127; advertisement for Aacer Flooring, p. 226; advertisement for Spidertile, p. 236; advertisement for Mateflex, p. 259; advertisement for SportCourt, pp. 280-281; Feb. 2004.

Brochure, "It's Not Just a Sports Floor," Sport Court Performance Sports Flooring, prior to Jun. 16, 2010.

A Complete Guide to Sports Surfaces and Flooring, advertisement for Sport Court, p. 5; advertisement for Multi-Play Sports Flooring, p. 9; advertisement for Rubber Products, p. 9; advertisement for SnapCourt Floors, p. 12; advertisement for Dynamic Sports Constructions, Inc., p. 22; advertisement for Versacourt, p. 23; advertisement for Swiss Flex, p. 26; advertisement for SportMaster Sport Surfaces, p. 26; advertisement for Centaur Floor Systems, p. 30; advertisement for All Deck, p. 30, Jul./Aug. 2005.

Program for AVCA 2003 Annual Convention, advertisement for Mateflex p. 12, Dec. 2003.

Athletic Business, advertisement for Dri-Dek, p. 47; advertisement for Mateflex, p. 97; advertisement for Duragrid, p. 132, advertisement for Kiefer Specialty Flooring, Inc., p, 134; Dec. 2003.

Athletic Business, advertisement for Mateflex, p. 16; advertisement for Aacer Flooring, p. 41; advertisement for Sport Court, p. 50; advertisement for Dri-Dek, p. 83; advertisements for Homer Flooring Co., Kiefer Specialty Flooring, Inc., and Mateflex-Mele Corp., p. 103; advertisements for Oscoda Plastics, Inc. and Premier Tiles, p. 104; advertisements for Spidercourt, Inc., Sport Court, Inc., Sport Floors, Inc., Sporturf, Sprinturf, Sri Sports, Inc., Superior Floor Company, Inc., and Synthetic Surfaces, p. 106; Nov. 2003.

Athletic Business, advertisements for Dri-Dek and Fitness Flooring, p. 77; advertisements for Dri-Dek/Kendall Products and Duragrid, p. 91; advertisement for Mateflex-Mele Corp., p. 94; advertisements for Dri-Dek/Kendall Products, Dodge-Regupol, Inc., p. 104; Jul. 2002.

Athletic Business, advertisement for Dri-Dek, p. 83; Jul. 2004.

Athletic Business, advertisement for Aacer Flooring, p. 10; advertisement for SnapCourt Sports Floor, p. 14; advertisement for Dri-Dek, p. 65; advertisement for Mateflex, p. 231; advertisement for Sport Court, pp. 241-243; advertisements for ProLine SPF and Swiss Flex, p. 245; Feb. 2005.

Athletic Business, advertisement for Dri-Dek, p. 12; advertisement for Mateflex, p. 91; advertisements for Dri-Dek, Everlast Performance Flooring, p. 112; advertisement for Mateflex, p. 115; Aug. 2005.

Athletic Business, advertisement for Mateflex, p. 51; advertisement for Dri-Dek, p. 63; advertisement for Dri-Dek, p. 96; Aug. 2004.

Recreation Management, advertisements for Taraflex Sports Flooring, Aacer Flooring, LLC, Action Floor Systems, Aeson Flooring Systems, Centaur Floor Systems, LLC, Swiss Flex, Sport Court International, p. 127; advertisements for Mitchell Rubber Products, Fitness Flooring, Summit Flexible Products, Premier Court, p. 218; advertisement for Aacer Flooring, p. 221; advertisements for SportMaster Sport Surfaces and Swiss Flex, p. 227; advertisement for Sport Court, p. 229; Dec. 2004.

(56) References Cited

OTHER PUBLICATIONS

Grassroots Motorsports, advertisement for RaceDeck, p. 61; Article, "Floored—Two Ways to Make Your Shop Floor Look Beautiful," pp. 125-126, Mar. 2002.

Athletic Business; advertisement for Dri-Dek, p. 55; advertisements for Rubber Products and Multi-Play Sports Flooring, p. 139; advertisement for Fitness Flooring, p. 167; advertisement for Mateflex, p, 233; advertisements for Centaur Floor Systems and Flex Court, p. 250; advertisement for Athletic Surface Systems (Sports Court), pp. 281-284; Feb. 2006.

Club Management, advertisement for Duragrid, p. 161; Apr. 2002.

Athletic Business, advertisement for Sport Court, p. 39; advertisement for Dri-Dek, p. 49; advertisement for VersaCourt, p. 93; Sep. 2004.

Recreation Management, advertisement for Sport Court, p. 9; advertisement for Dri-Dek, p. 21; May/Jun. 2005.

Athletic Business, advertisement for Dri-Dek, p. 16; advertisement for SpiderTile, p. 20; advertisement for Mateflex, p. 69; advertisements for Premier Tiles, Prestige Enterprises International, Inc., Rhino Sports, and Robbins Sports Surfaces, p. 139; advertisements for SpiderCourt Inc., Sport Court Inc,, and Sport Floors, Inc., p. 141, Apr. 2003.

Institutional Flooring, Competitive Information, Sport Court, Jan. 2004.

Advertisement for IceCourt XS, prior to Jun. 16, 2010.

Brochure for Mateflex, 8 pages, prior to Jun. 16, 2010.

* cited by examiner

MODULAR FLOOR TILE WITH RESILIENT SUPPORT MEMBERS

CROSS REFERENCE TO RELATED APPLICATIONS

This is a continuation of U.S. application Ser. No. 12/945,195, filed 12 Nov. 2010, now issued as U.S. Pat. No. 8,656,662, issued on 25 Feb. 2014, which is a divisional of U.S. Pat. No. 8,099,915, issued on 24 Jan. 2012, which is a continuation-in-part of U.S. Pat. No. 7,587,865, issued on 15 Sep. 2009, which is a continuation-in-part of U.S. Pat. No. 7,958,681, issued on 14 Jun. 2011, which is a continuation-in-part of U.S. Pat. No. 7,571,572, issued on 11 Aug. 2009, the disclosures of which are incorporated in their entireties by this reference.

TECHNICAL FIELD

This relates generally to floor tiles, and more particularly to modular floor tiles with multiple level support systems.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor. Other interconnected tile systems are used as dance floors and sports court surfaces.

However, typical interconnected tile systems are rigid and unforgiving. Short and long term use of modular floors for sports activities and dance can result in discomfort to the users. Conventional interconnected tile systems absorb little, if any, of the impact associated with walking, running, jumping, and dancing. Consequently, some users may experience pain or discomfort of the joints when using the interconnected tile systems. Therefore, there is a need for modular interconnected tile systems that include features that provide a more comfortable, useful surface.

SUMMARY

Some embodiments address the above-described needs and others. In one of many possible embodiments, a modular floor tile is provided. The modular floor tile comprises a top surface, a plurality of edge surfaces, an interlocking mechanism for attachment to adjacent tiles, and a support system comprising multiple levels of support. In one embodiment, at least one of the multiple levels of support comprises a first resilient level, and another of the multiple levels of support comprises a first rigid level. In one embodiment, the first resilient level comprises a plurality of inserts disposed under the top surface. In one embodiment, the first resilient level comprises a plurality of interconnected elastomeric removable inserts nested under the top surface. In one embodiment, each of the plurality of inserts comprises a length equal to or greater than a height of the plurality of edge surfaces. In one embodiment, the plurality of inserts each comprise a generally cylindrical post. In one embodiment, the at least one insert comprises a base and a post extending from the base. According to one embodiment, the top surface comprises a solid surface.

In one embodiment of the modular floor tile, the first rigid level of the multiple levels of support comprises a first set of support legs having a first length extending from the top surface, and the multiple levels of support comprise a second rigid level comprising a second set of support legs having a second length, the second length being shorter than the first length. In one embodiment, the first and second sets of support legs are arranged in an alternating pattern comprising a first leg of the first length, a group of three to four legs of the second length, and the resilient level comprises a plurality of inserts nested in the group of three to four legs. The resilient level may extend in length beyond the first and second rigid levels. In one embodiment, the first resilient level comprises a plate of multiple inserts interconnected by a webbing, the plate shaped substantially the same as the top surface.

In one embodiment of the modular floor tile, the top surface comprises an open surface. The open surface comprising a pattern of gaps, and the first resilient level comprises a plurality of elastomeric inserts with a length greater than a height of the edge surfaces, each of the plurality of inserts comprising a base and a post extending from the base. The post is sized small enough to pass through one of the gaps, and the base is sized large enough to resist passage through one of the gaps. In one embodiment, each of the plurality of elastomeric inserts comprises a post straddling the open surface at the gaps.

In one embodiment of the modular floor tile, the interlocking mechanism comprises a plurality of lipped loops disposed in at least one of the plurality of edge surfaces, and a plurality of locking tab assemblies disposed in at least one of the plurality of edge surfaces. Each of the plurality of locking tab assemblies comprises a center post and flanking hooks.

One embodiment provides an apparatus comprising a modular floor. The modular floor comprises a plurality of interlocking tiles connected to one another. Each of the plurality of interlocking tiles comprises a top surface and a plurality of support levels under the top surface. The plurality of support levels comprises at least one rigid level and at least one flexible level extending beyond the at least one rigid level. In one embodiment, at least one flexible level comprises a plurality of elastomeric inserts, and each of the plurality of interlocking tiles comprises a bottom, the bottom including a plurality of receivers sized to hold one of the plurality of elastomeric inserts.

One aspect provides a method of making a modular floor. The method comprises providing an interlocking modular tile having a top surface and a bottom plane parallel to and spaced from the top surface, inserting a plurality of resilient inserts into associated nests opposite of the top surface, and protruding the plurality of resilient inserts beyond the bottom plane. In one aspect, the top surface comprises a solid top surface, and the inserting further comprises contacting an underside of the top surface with the plurality of resilient inserts. In one aspect, inserting comprises inserting the resilient inserts as a single, interconnected unit of inserts. In one aspect, inserting further comprises fitting the plurality of resilient inserts into a nest by an interference fit. In one aspect, the top surface comprises an open surface, and inserting comprises pressing the plurality of resilient inserts through associated gaps in the first open surface in a first direction.

In one aspect of the method, the plurality of resilient inserts comprise a first support level. In one aspect, the method further comprises providing a second, rigid support level flush with the bottom plane, and providing a third, rigid support level between the bottom plane and the top surface.

One aspect provides a method of making a modular tile comprising forming a tile body having a solid top surface, providing a plurality of elastomeric inserts having a length at least as great as a height of the tile body, and pressing the plurality of elastomeric inserts into nests under the solid top surface. In one aspect, providing a plurality of elastomeric inserts comprises providing an interconnected webbing of the elastomeric inserts.

According to at least one embodiment, a modular floor tile may comprise a top surface layer, a plurality of edge surfaces, an interlocking mechanism for attachment to adjacent tiles, and a support system. The support system may comprise a first rigid level and at least one resilient support member disposed under the top surface layer, the at least one resilient support member extending to a distance further from the top surface layer than the first rigid level, wherein the at least one resilient support member is compressible toward the top surface layer.

According to an additional embodiment, an apparatus may comprise a modular floor, the modular floor comprising a plurality of interlocking tiles connected to one another. Each of the plurality of interlocking tiles may comprise a top surface layer and a plurality of edge surfaces. Each of the plurality of interlocking tiles may also comprise a plurality of support levels under the top surface layer, the plurality of support levels comprising at least one rigid level and at least one resilient support member disposed under the top surface layer, wherein the at least one resilient support member may be compressible toward the top surface layer.

According to various aspects, a method of forming a modular floor may comprise providing an interlocking modular tile having a top surface layer, a bottom plane substantially parallel to and spaced from the top surface layer, and a first rigid support level flush with the bottom plane. The method may further comprise inserting a plurality of resilient inserts into associated nests adjacent to the top surface layer such that the plurality of resilient inserts protrude beyond the bottom plane.

The foregoing features and advantages, together with other features and advantages, will become more apparent when referring to the following specification, claims and accompanying drawings.

BRIEF DESCRIPTION OF THE DRAWINGS

The accompanying drawings illustrate various embodiments and are a part of the specification. The illustrated embodiments are merely examples and do not limit the claims.

Throughout the drawings, identical reference numbers designate similar, but not necessarily identical, elements.

DETAILED DESCRIPTION

As mentioned above, typical modular flooring comprises solid or open top surfaces that tend to be slippery. The slippery surfaces compromise the footing of users, especially sports court users that tend to start and stop abruptly. The typical modular floor offers less than ideal traction to dance, sport, pedestrian, and other traffic. The principles described herein present methods and apparatus that provide better traction and more flexibility than previous flooring systems. However, the application of the principles described herein is not limited to the specific embodiments shown. The principles described herein may be used with any flooring system. Moreover, although certain embodiments shown incorporate multiple novel features, the features may be independent and need not all be used together in a single embodiment. Tiles and flooring systems according to principles described herein may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. "Resilient" means capable of returning to an original shape or position, as after having been compressed; rebounds readily. "Rigid" means stiff or substantially lacking flexibility. However, a "rigid" support system may flex or compress somewhat under a load, although to a lesser degree than a "resilient" support system. A "post" is a support or structure that tends to be vertical. A "top" surface of a modular tile refers to the exposed surface when the tile is placed on a support, or the designated surface for stepping on, driving on, supporting objects, etc. An "insert" is an object at least partially inserted or intended for insertion relative to another object. A "post" may be cylindrical, but is not necessarily so. The words "including" and "having," as used in the specification, including the claims, have the same meaning as the word "comprising."

Figure 1:
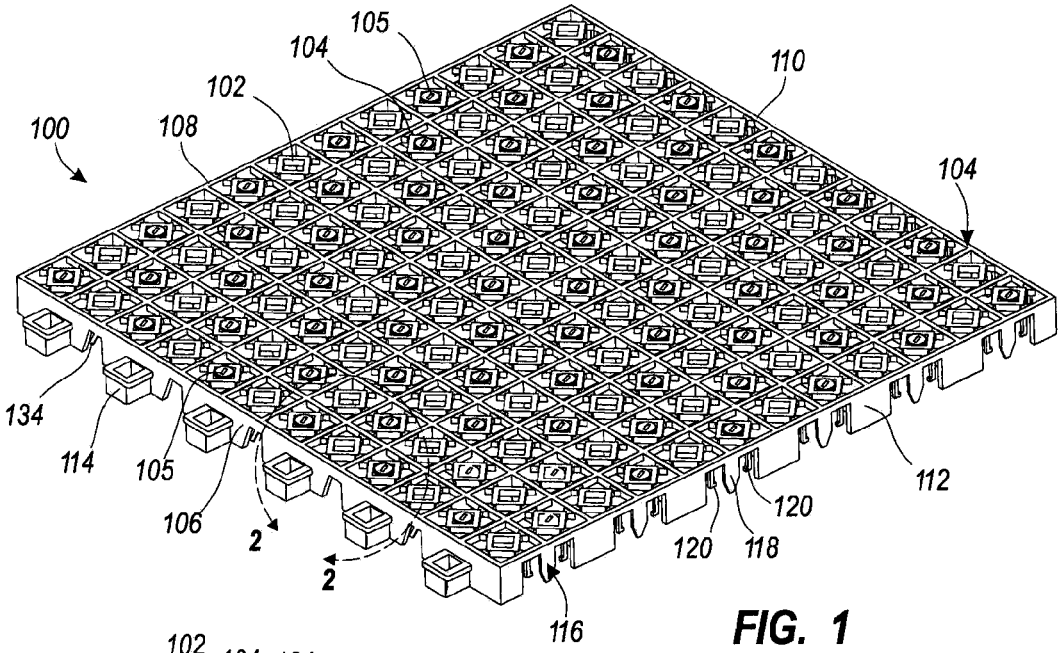
FIG. 1 is a perspective view of a modular floor tile with an open top surface and a plurality of non-slip inserts according to one embodiment.
Figure 2:
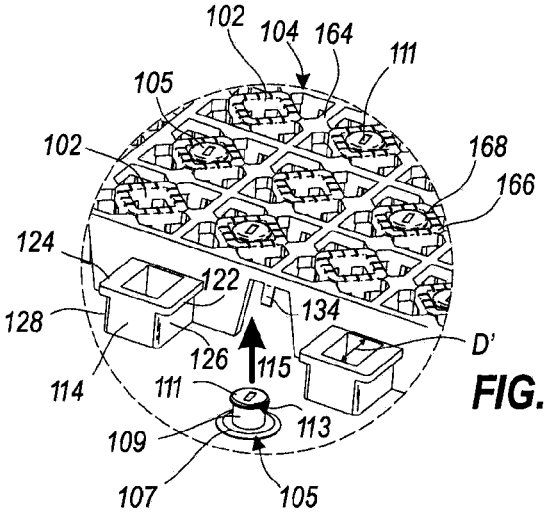
FIG. 2 is a magnified inset of a portion of the modular floor tile of FIG. 1.
Figure 3:
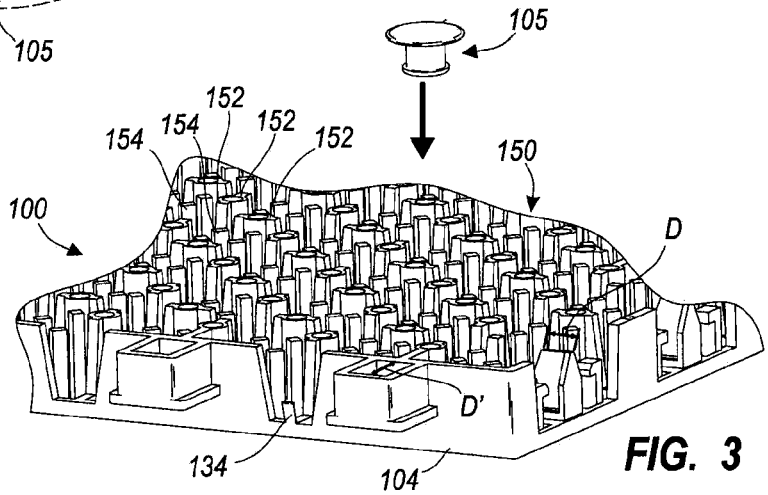
FIG. 3 is a partial bottom assembly view of the modular floor tile of FIG. 1.

Referring now to the drawings, FIGS. 1-3 illustrate in partial assembly view a modular floor tile 100 according to one embodiment. The modular floor tile 100 of FIGS. 1-3 may comprise injection molded plastic. The modular tile 100 and other similar or identical tiles may be interlocked according to principles described herein to form a floor, such as a sports court floor discussed below with reference to FIG. 8E. However, unlike conventional modular flooring systems, the modular tile 100 facilitates extra traction and more resiliency by the addition of nonslip inserts, support legs, and/or resilient support members.

The modular tile 100 of FIGS. 1-3 comprises a first or top open surface 104. The term "open" indicates that the top open surface 104 includes open holes, gaps, or spaces through which fluid may drain. For example, the modular tile 100 of FIGS. 1-3 may include a plurality of diamond shaped holes 102 patterned relative to the rectangular or square shape of the modular tile 100 as shown. However, any other shape for the gaps 102 and the modular tile 100 may also be used.

Each of the holes 102 in the open surface 104 is receptive of an insert 105. However, it is not necessary for every hole 102 to include an insert 105. For example, FIGS. 1-3 illustrate an insert 105 disposed in every other hole 102. Nevertheless, some embodiments include inserts 105 in every hole 102, and other embodiments may include other spacings between the inserts 105. The insert 105 may be inserted or removed from the modular tile 100. According to some embodiments, however, the insert 105 may be permanently attached to the modular tile 100. The insert 105 is insertable at least partially into the holes 102 and protrudes from the plane of the open surface 104.

The insert 105 may comprise a resilient material, which may be an elastomer such as rubber and may include many different shapes. For example, as shown in FIGS. 1-3, the insert 105 may include a base 107 with a post or compressible column 109 extending normally from the base. The post 109 may terminate at an end 113 with a pad 111 opposite of the base 107. As shown in FIGS. 1-3, the base 107 may be generally circular, and the post 109 may be generally cylindrical. The base 107 and the pad 111 may comprise first and second radial lips, respectively, extending radially from the post 109.

Figure 4:
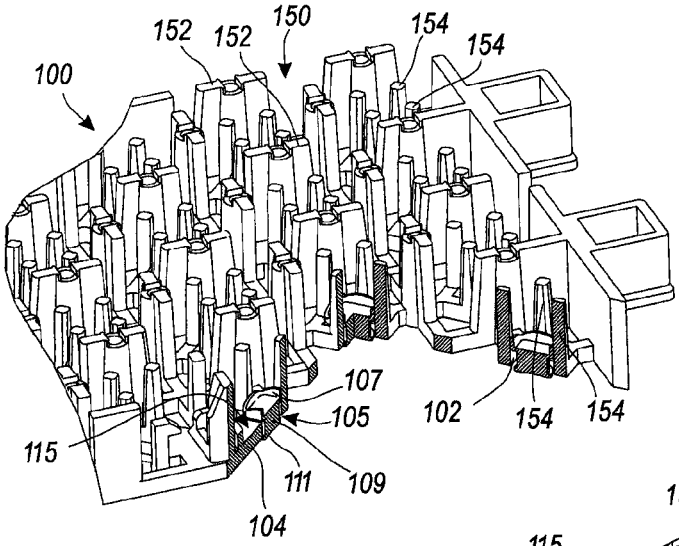
FIG. 4 is a magnified partial cross-sectional view of the modular floor tile of FIG. 1.
Figure 5:
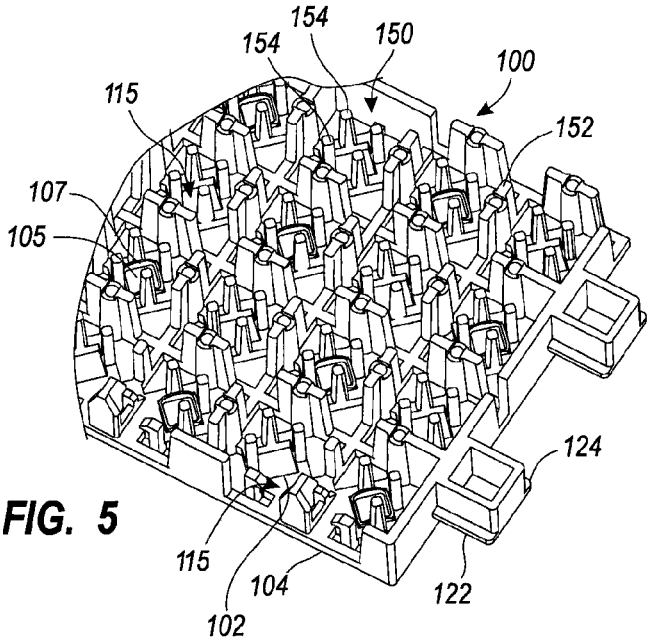
FIG. 5 is a magnified bottom perspective view of the modular floor tile of FIG. 1.

As shown in FIGS. 1-3, the post 109 is sized small enough to pass easily though the holes 102 and protrude from the open surface 104. The base 107, on the other hand, is sized large enough to resist passage though the holes 102. Therefore, the insert 105 may be inserted from the bottom of the modular tile 100 until the base 107 contacts the periphery of the holes 102. As shown in FIGS. 4-5, the base 107 of the insert 105 may nest in a receiver or holder 115 of the modular tile 100. The receiver 115 is sized smaller than the base 107 to provide an interference fit between the insert 105 and the receiver 115 and generally hold the insert 105 tightly in place. However, the insert 105 is resilient and therefore may be removed from the interference fit with the receiver 115 by applying an adequate force to the insert 105. The receiver 115 may comprise a number of legs 154 described in more detail below with reference to FIGS. 3-5. The base 107 deforms around the legs 154 as shown in FIGS. 4-5 to partially hold the insert 105 in place.

Continuing to refer to FIGS. 4-5, the base 107 and the pad 111 may straddle or partially straddle the open surface 104 of the modular floor tile 100. The pad 111 may be sized to slightly resist passage through the holes 102. Therefore, the insert 105 may be inserted into one of the holes 102 by applying a sufficient force to the insert 105 to elastically deform the pad 111 as it passes through the hole 102. The pad 111 may be tapered or rounded to facilitate insertion through the hole 102 in an insertion direction. When the pad 111 emerges through the hole 102, it tends to resume its original shape and resist passing back out of the hole 102 in a direction opposite of the insertion direction. Nevertheless, the pad 111 tends to displace to a generally flush position relative to the open surface 104 upon the application of force. The post 109 is also resilient and compressible, and a sufficient force on the pad 111 (e.g. a person stepping on the pad) causes the post 109 to compress without displacing the base 107 within the receiver 115.

The protruding inserts 105 advantageously provide traction and comfort to users of the modular tile 100. As mentioned above, the inserts 105 may be elastomeric, and soft elastomeric materials such as rubber and santoprene provide excellent traction for users. The inserts 105 are compressible as well, providing a comfortable surface for users to walk across. The number of inserts 105 used with the modular tile 100 may be varied according to preference. Moreover, as described below, the modular tile 100 includes an interlocking mechanism for attachment to adjacent tiles. Therefore, multiple modular tiles 100 may be interlocked to create a floor of any size and shape. One embodiment of an interlocking mechanism is described in the following paragraphs.

The modular tile 100 includes a plurality of side edges, which, according to the embodiment of FIGS. 1-3, include four side edges 106, 108, 110, 112. At least one of the side edges of the modular tile 100 includes a plurality of loops 114. However, according to the embodiment of FIGS. 1-3, a plurality of loops 114 is disposed in each of the first and second adjacent side surfaces 106, 108. The loops 114 may be spaced along the first and second side surfaces 106, 108 at substantially equal intervals.

Each of the plurality of loops 114 is receptive of a mating locking tab assembly 116 from an adjacent modular tile. According to the embodiment of FIGS. 1-3, each of the third and fourth adjacent side surfaces 110, 112 includes a plurality of locking tab assemblies 116. The modular tile 100 may include an equal number of locking tab assemblies 116 and loops 114. Moreover, the locking tab assemblies 116 may be spaced at the same intervals as the loops 114.

Figure 6:
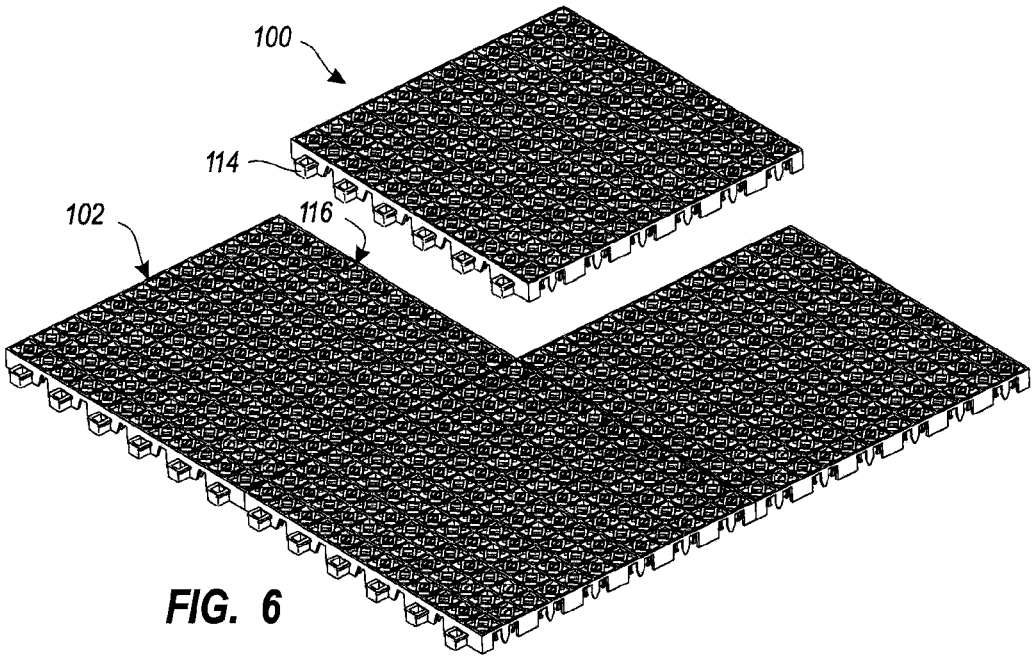
FIG. 6 is a perspective assembly view of multiple modular floor tiles according to one embodiment.

Referring now to FIG. 6, the loops 114 of the modular tile 100 are receptive of the locking tab assemblies 116 of an adjacent modular tile such as a second tile 102. Thus, the first and second modular tiles 100, 102 may be interlocked or connected together. FIG. 6 illustrates three modular tiles already interconnected, and fourth modular tile 100 being attached to the other three.

Figure 7:
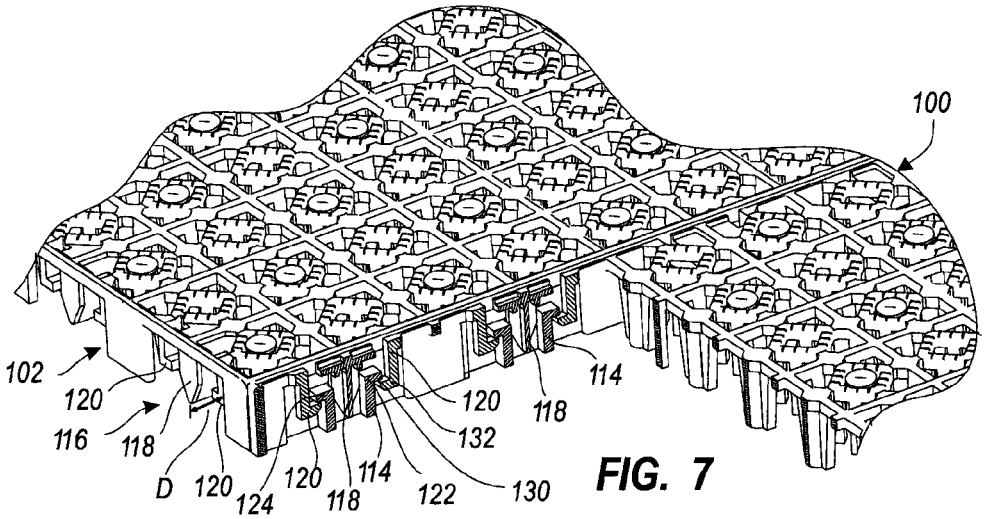
FIG. 7 is partial cross sectional view of the modular floor tiles of FIG. 6 illustrating the connection between tiles according to one embodiment.

FIG. 7 best illustrates the details of the interconnection between adjacent modular tiles 100, 102. Each of the locking tab assemblies 116 may comprise a center post 118 of depth D and flanking hooks 120. The flanking hooks 120 may be cantilevered. In addition, as best shown in FIG. 2, each of the loops 114 comprises a rim or lip, which may include first and second lips 122, 124 protruding from first and second sides 126, 128, respectively, of the loops 114. As the adjacent modular tiles 100 are locked together as shown in FIG. 7, the center post 118 is inserted into the associated loop 114, and the flanking hooks 120 flex around and snap-fit over the associated lips 122, 124. Once snapped over the lips 122, 124, the flanking hooks 120 resist disconnection of the adjacent modular tiles 100. However, the length of the flanking hooks 120 provides a vertical clearance 130 between the lips 122, 124 and prongs 132 of the flanking hooks 120. The vertical clearance 130 allows adjacent, interlocked modular tiles 100 to displace vertically a predetermined distance with respect to one another, even while remaining interlocked. According to some embodiments, the vertical clearance 130 (and thus the vertical displacement) comprises at least about 0.0625 inches, and may be at least about 0.125 inches or more. Moreover, the flanking hooks 120 comprise double locks and operate independent of one another. Therefore, even if one of the flanking hooks 120 breaks or is otherwise incapacitated, the lock between the locking tab assembly 116 and the loop 114 remains intact.

In addition, although the prongs 132 of the flanking hooks 120 provide a double lock against disconnection of the adjacent modular tiles 100, they permit sliding lateral displacement between the adjacent modular tiles 100. A predetermined amount of sliding lateral displacement between the adjacent modular tiles 100 may be controlled, for example, by the depth D of the center post 118, in combination with the depth D' (FIG. 2) of the loop 114. A predetermined clearance between the depth D of the center post 118 and the depth D' (FIG. 2) of the loop 114 may fix the maximum lateral displacement between the adjacent modular tiles 100. According to some embodiments, the predetermined lateral displacement may be at least 0.0625 inches, and may be at least about 0.100-0.125 inches. Thus, the interconnection between adjacent modular tiles 100 according to some embodiments, advantageously permits some relative displacement both vertically and laterally, and provides a more comfortable feel to users, especially at quick stops and starts.

However, although some embodiments facilitate lateral displacement between interlocked modular tiles, a complete floor may tend to look sloppy and misaligned in some configurations. Therefore, according to some embodiments, adjacent modular tiles may be biased or spring loaded to a specific, generally equal spacing therebetween. Referring to FIGS. 1-3 one or more of the side walls 106-112 may include one or more biasing members such as spring fingers 134 disposed therein. The spring fingers 134 may comprise three cantilevered, angled spring fingers spaced between alternating loops 114 and disposed in both of the first and second side walls 106, 108. Nevertheless, the spring fingers 134 may just as effectively be placed in the third and fourth side walls 110, 112, or even in all four side walls. The spring fingers 134 thus tend to bear against adjacent side walls of adjacent tiles, aligning all of the modular floor tiles in a floor to a substantially equal spacing, while also permitting lateral displacement upon the application of a sufficient lateral force.

Each of the modular tiles 100 includes a support system under the top open surface 104. According to some aspects, the support system comprises a multiple-tier suspension system. One embodiment of the multiple-tier suspension system is illustrated in FIGS. 3-5, and comprises a two-tier suspension system 150. The two-tier suspension system 150 comprises a plurality of support legs extending down from the first open surface 104. The plurality of support legs may comprise a first set of generally rigid primary support legs 152 having a first length, and a second set of generally rigid support legs 154 having a second length. The second length of the second set of support legs 154 is shorter than the first length of the first set of support legs 152. Therefore, absent a load, only the first set of support legs 152 contacts the ground. The first and second sets of support legs 152, 154 may be arranged in an alternating pattern as shown in FIG. 3. The pattern may comprise alternating rows or columns of first and second sets of support legs 152, 154. In addition, the first set of support legs 152 may each comprise a split or fork leg as shown, and the second set of support legs 154 may comprise clusters of three or four legs. The inserts 105 may be nested in one or more of the groups of three or four legs. Thus, the base 107 of the insert 105 may be deformed around the legs 154 by forcing the insert 105 into the cluster of three or four legs, causing the base 107 to bear against the legs, which tends to hold the insert 105 fast. The second set of support legs 154 may thus comprise the receiver 115.

The spacing of the first set of support legs 152 facilitates vertical flexing or springing of each of the modular tiles 100. That is to say, as a load is applied to one or more of the modular tiles 100, 102 on the first open surface 104, the first open surface 104 "gives" or tends to flex somewhat, until the second set of support legs 154 contacts the ground. In addition, the inserts 105 tend to compress as they are stepped on. Accordingly, application of the principles described herein may result in a comfortable spring-like modular floor.

Figure 8:
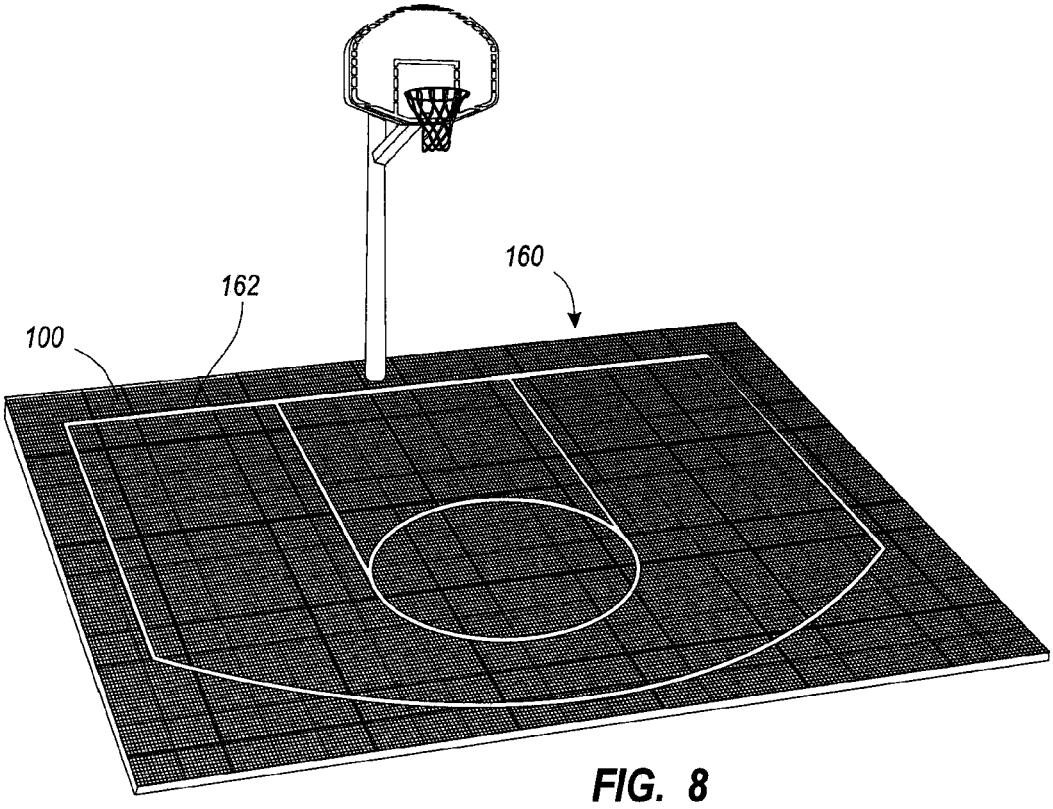
FIG. 8 is a perspective view of a modular floor arranged as a sports court according to one embodiment.

The modular tile 100 described above, along with a plurality of additional similar or identical modular tiles, may be arranged in any configuration to create a floor. For example, as shown in FIG. 8, a plurality of modular tiles 100 may be arranged to form a sports court floor 160, such as a basketball, tennis, volleyball, and/or other type of sports court floor, without limitation. The sports court floor 160 may include lines corresponding to regulation sports floor lines, such as the basketball court lines 162 shown in FIG. 8A. The lines may be painted onto or otherwise formed in the modular tiles 100.

For many uses of the modular tiles 100, including the sports court floor 160, traction can be important. Therefore, nonslip inserts 105 (FIG. 2) provide a significant advantage over traditional modular floors. According to some embodiments, the modular tiles 100 include multiple traction layers. For example, as shown in FIG. 2, the modular tile 100 comprises four traction layers. A first of the three traction layers may comprise a first webbing 164 that runs in lines generally parallel and perpendicular to edges of the modular tile 100. The first webbing 164 is at a first elevation that may be, for example, at about 0.6875 inches from a ground surface (the height of the side walls 106-112 (FIG. 1) may be about 0.75 inches). A second of the traction layers may comprise the general diamond pattern surface 166 defining the holes 102, and are disposed in between perpendicular lines of the first webbing 164. The diamond pattern surface 166 may be substantially flush with the side wall height at about 0.75 inches. A third traction layer may comprise a plurality of ridges 168 protruding from the diamond pattern surface 166. The plurality of ridges 168 may comprise three ridges in each side of the diamond pattern. The plurality of ridges 168 may be elevated slightly from the diamond pattern surface 166 a distance of about 0.05-0.125 inches. A fourth traction layer may comprise the pad 111 of the protruding insert 105. The four traction layers 164, 166, 168, 111 provide exceptional traction and reduce the risk of slipping and other hazards.

Referring again to FIG. 1, according to some aspects, the modular floor tiles 100 may be made by providing a mold, injecting liquid polymer into the mold, shaping the liquid polymer with the mold to provide a top surface 104 and an interlocking system 114, 116, and solidifying the liquid polymer. The inserts 105 may then be inserted into the holes 102 in the top surface 104 through the bottom of the tile 100 in a first direction indicated by arrows in FIGS. 2-3. The inserts 105 are pushed into the holes 102 until the pads 111 protrude from the top surface 104 and the inserts 105 deform to a snug or interference fit with the receiver 115 (FIG. 4) or other component of the tile 100. Thus the pads 111 and the bases 107 straddle the top surface 104. The shaping of the modular tiles 100 may comprise creating the plurality of loops 114 disposed in at least one side edge 106 (FIG. 1), the loops 114 having a protruding rim 122, and creating a plurality of locking tab assemblies 116 (FIG. 1) disposed in at least one other side edge 108, each of the plurality of locking tab assemblies 116 (FIG. 1) comprising a center post 118 and flanking hooks 120 (FIG. 1). The method may further comprise varying a depth D (FIG. 7) of the center posts in the mold to adjust the predetermined amount of lateral sliding allowed between adjacent tiles.

Figure 9:
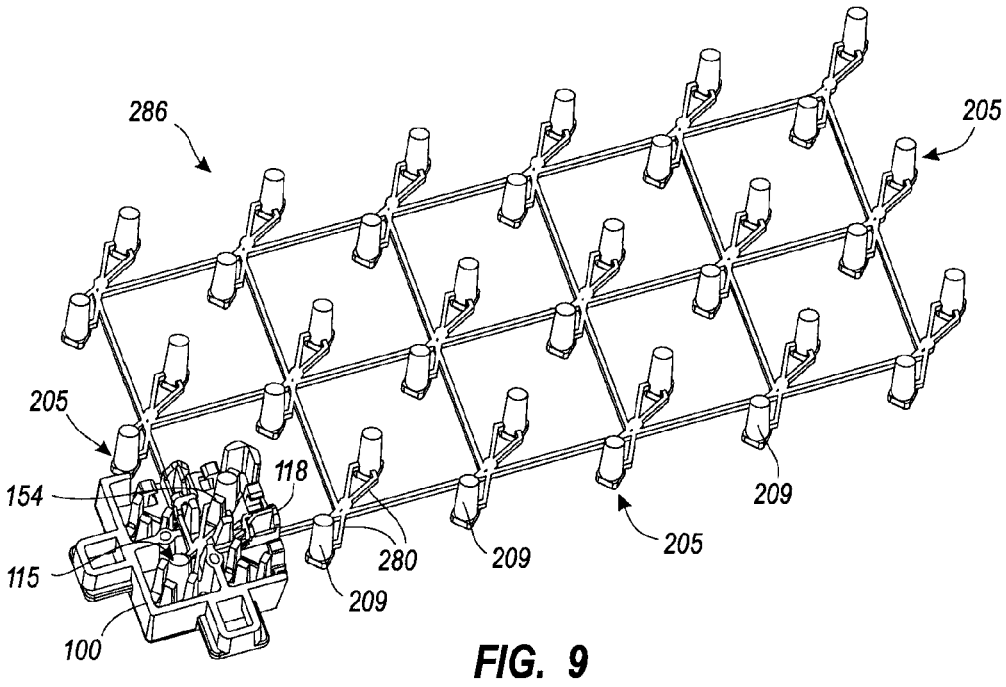
FIG. 9 is a bottom perspective cut-away view of a partial tile and a plurality of interconnected inserts according to another embodiment.
Figure 10:
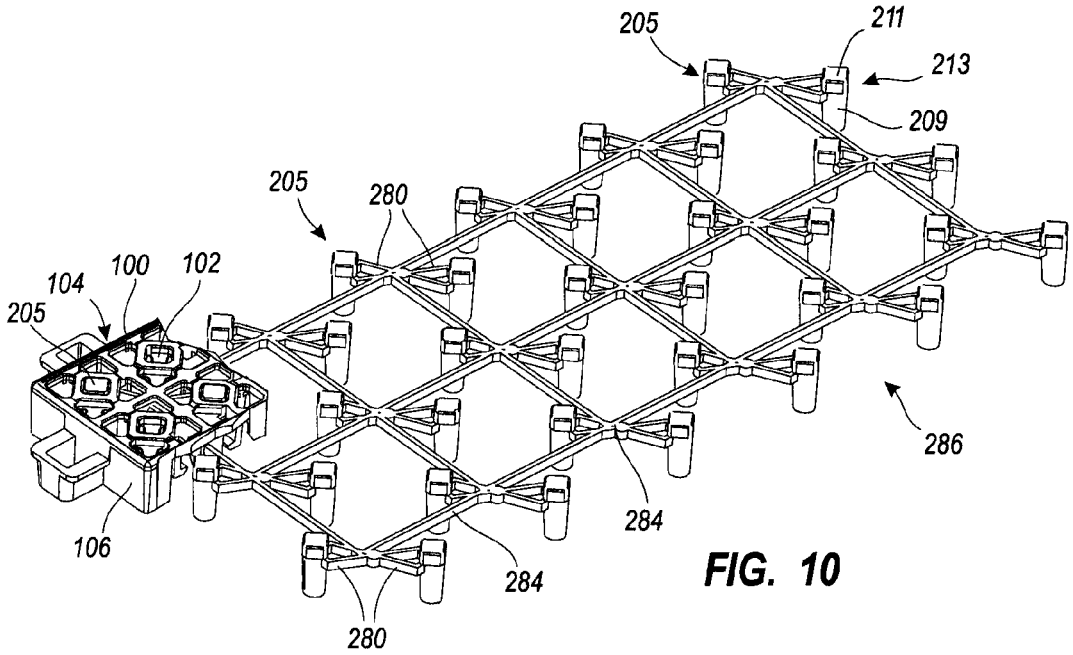
FIG. 10 is a top perspective cut-away view of the tile and nonslip inserts of FIG. 9.
Figure 11:
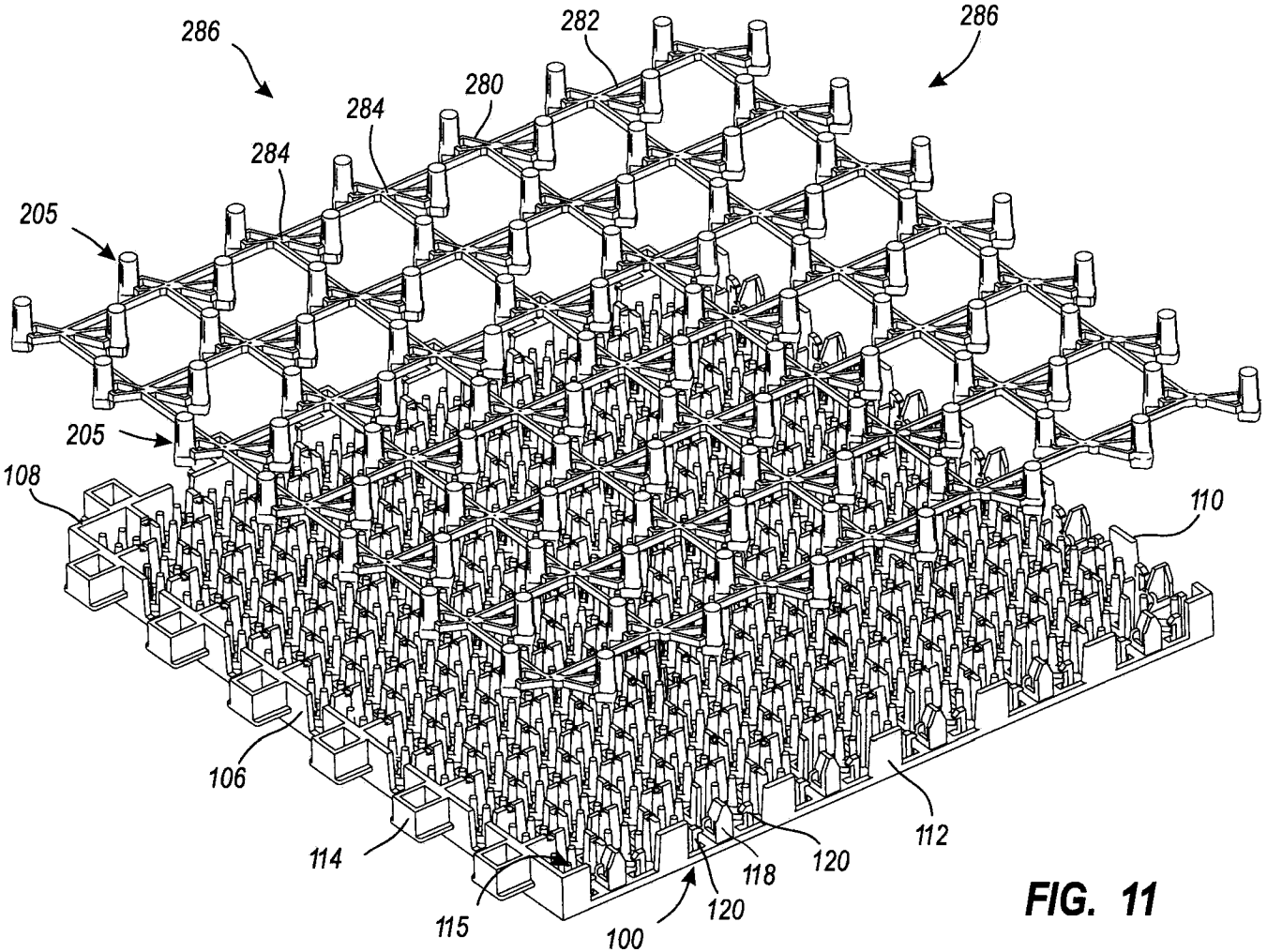
FIG. 11 is an assembly view of a full tile and multiple interconnected inserts according to one embodiment.
Figure 12:
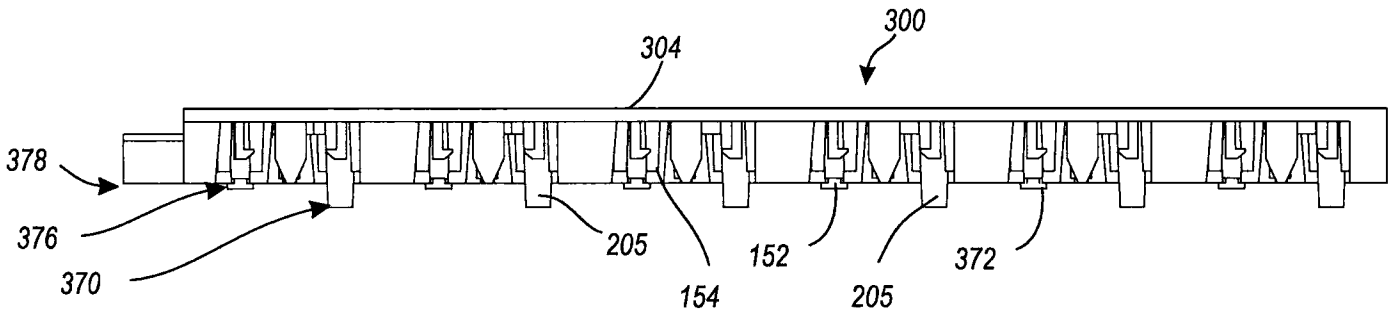
FIG. 12 is a side view of a tile with multiple levels of support according to one embodiment.

Referring next to FIGS. 9-11, another embodiment of inserts is disclosed. According to one embodiment, the modular floor tile 100 is accompanied by one or more full-length nonslip inserts 205. Each of the holes 102 in the open surface 104 of the modular floor tile 100 is receptive of a full-length insert 205. However, as with the inserts 105 described above, it is not necessary for every hole 102 to include a full-length insert 205. For example, FIGS. 9-11 illustrate a full-length insert 205 disposed in every other hole 102. Nevertheless, some embodiments include full-length inserts 205 in every hole 102, and other embodiments may include other spacings between the full-length inserts 205. The full-length inserts 205 may be inserted or removed from the modular tile 100. According to some embodiments, however, the full length inserts 205 may be permanently attached to and comprise the modular tile 100. The full-length inserts 205 are insertable at least partially into the holes 102 and protrude from the plane of the top open surface 104.

Unlike the inserts 105 illustrated above, the full-length inserts 205 may be substantially equal in length to, or slightly longer than, the side walls 106-112. Therefore, the full-length inserts 205, when assembled in the floor tile 100 and setting on a support surface, cannot fall out of the holes 102. The full length inserts 205 contact the ground or other support surface and extend though the open surface 104 in the floor tile 100.

The full-length inserts 205 may comprise a resilient material, which may be an elastomer such as rubber, or it may comprise plastic or other non-slip materials. The full-length insert 205 may include many different shapes. For example, as shown in FIGS. 9-11, the full-length insert 205 may include a base comprising a post or compressible column 209. The post 209 may be generally cylindrical, and may include a taper. The post 209 may terminate at an end 213 with a pad 211. The pad may be rectangular or square. According to one embodiment, the pad 211 is substantially the same shape as the holes 102 in the floor tile 100. The pad 211 may be slightly oversized with respect to the holes 102, creating a snug or interference fit between the pad 211 and the holes 102.

The full-length inserts 205 may be inserted from the bottom of the modular tile 100. As shown in FIG. 9, according to one embodiment, the full-length inserts 205 may nest in the receivers or holders 115 of the modular tile 100. According to one embodiment, the full-length inserts 205 may come in pairs and may be interconnected by a pair of generally triangular webbings 280. When assembled, one of the legs 154 of the floor tile 100 may extend through the triangular webbing 280 as shown in FIG. 9.

As shown in FIG. 11, according to one embodiment, a plurality of full-length inserts 205 may be injection molded together as a unit. The unit may comprise substantially the same shape as the floor tile 100. Therefore, a set or plate 286 of full-length inserts 205 may be pressed into the holes 102 of the floor tile 100 at once. A webbing, for example a generally rectangular webbing 282, may interconnect the full-length inserts 205 in the same general shape as the floor tile 100 or open surface 104. The generally triangular webbing 280 may be offset at an angle with respect to the generally rectangular webbing 282. For example, according to one embodiment, the generally triangular webbings 280 interconnecting pairs of full length inserts 205 may be arranged at forty-five degree angles from intersection points 284 of the generally rectangular webbing 280. However, certain portions of the generally rectangular webbing 282 may break or be cut as the plate 286 of full length inserts 205 is installed. Portions of the generally rectangular webbing 282 may be cut because the generally rectangular webbing 280 may interfere with other components of the floor tile 100. For example, as best shown in FIG. 9, the generally rectangular webbing 280 may interfere with the center post 118. Therefore, the generally rectangular webbing 280 may be cut or predisposed to break as the full length inserts 205 of the plate 286 are pressed into the holes 102. The rectangular webbing 280 is flexible, however, so the webbing may also simply be re-routed around obstructions without being cut as well. It will be understood by those of ordinary skill in the art having the benefit of this disclosure, that the full length inserts 205 are not necessarily interconnected in the configuration shown in FIGS. 9-11. According to one embodiment, each full-length insert 205 is completely separate and individual. Other embodiments may include any number of full-length inserts 205 interconnected in any pattern.

Continuing to refer to FIGS. 9-11, the full-length inserts 205 may straddle or partially straddle the open surface 104 of the floor tile 100. As mentioned above, the pad 211 may be sized to slightly resist passage through the holes 102. Therefore, the full-length insert 205 may be inserted into one of the holes 102 by applying a sufficient force to the full-length insert 205 to elastically deform the pad 211 as it passes through the hole 102. The pad 211 tends to displace to a generally flush position relative to the open top surface 104 upon the application of force. The post 209 is resilient and compressible, and a sufficient force on the pad 211 (e.g. a person stepping on the pad) causes the post 209 to compress.

In one embodiment, the protruding full-length inserts 205 provide traction to users of the modular tile 100. As mentioned above, the full-length inserts 205 may be elastomeric, and soft elastomeric materials such as rubber and santoprene provide excellent traction for users. The full-length inserts 205 may be compressible as well, providing an addition level of support and a comfortable surface for users to walk across.

Some embodiments of the insert 105 and the full-length insert 205, however, may be rigid. The number of full-length inserts 205 used with the modular tile 100 may be varied according to preference. Moreover, as described above, the modular tile 100 includes an interlocking mechanism for attachment to adjacent tiles. Therefore, multiple modular tiles 100 may be interlocked to create a floor of any size and shape.

Another embodiment is disclosed in FIGS. 12-15. FIGS. 12-15 illustrate a modular floor tile 300 comprising a top surface 304. The top surface 304, however, may be solid, instead of open. The top surface 304 may be smooth or include raised or recessed features in any shape and pattern. Similar or identical to the embodiment of FIGS. 1-3, one embodiment of the modular floor tile 300 includes the four side edges or surfaces 106, 108, 110, 112. The side edges 106, 108, 110, 112 may include the same or similar features to those shown in FIGS. 1-7 for interlocking to adjacent tiles. Accordingly, in the embodiment of FIGS. 12-15, the first and second side edges 106, 108 include the loops 114, and the third and fourth adjacent side edges 110, 112 include a plurality of locking tab assemblies 116.

The modular floor tile 300 of FIGS. 12-15 includes a support system under the top surface 304 comprising multiple levels of support. According to one embodiment, at least one of the multiple levels of support comprises a first resilient level 370. In one embodiment, the first resilient level 370 comprises a plurality of the elastomeric, full length inserts 205 disposed under the top surface 304. Similar or identical to the embodiment shown in FIG. 11, the full length inserts 205 of FIGS. 12-15 may be interconnected, removable inserts nested under the top surface 304. As mentioned above, each of the full length inserts 205 may be substantially equal in length to, or slightly longer than, the side edges 106-112. Therefore, the full-length inserts 205, when the assembled in the modular floor tile 300, extend beyond a bottom plane 372 parallel to and spaced from the top surface 304. Accordingly, the full length inserts 205 contact the ground or other support surface.

Figure 14:
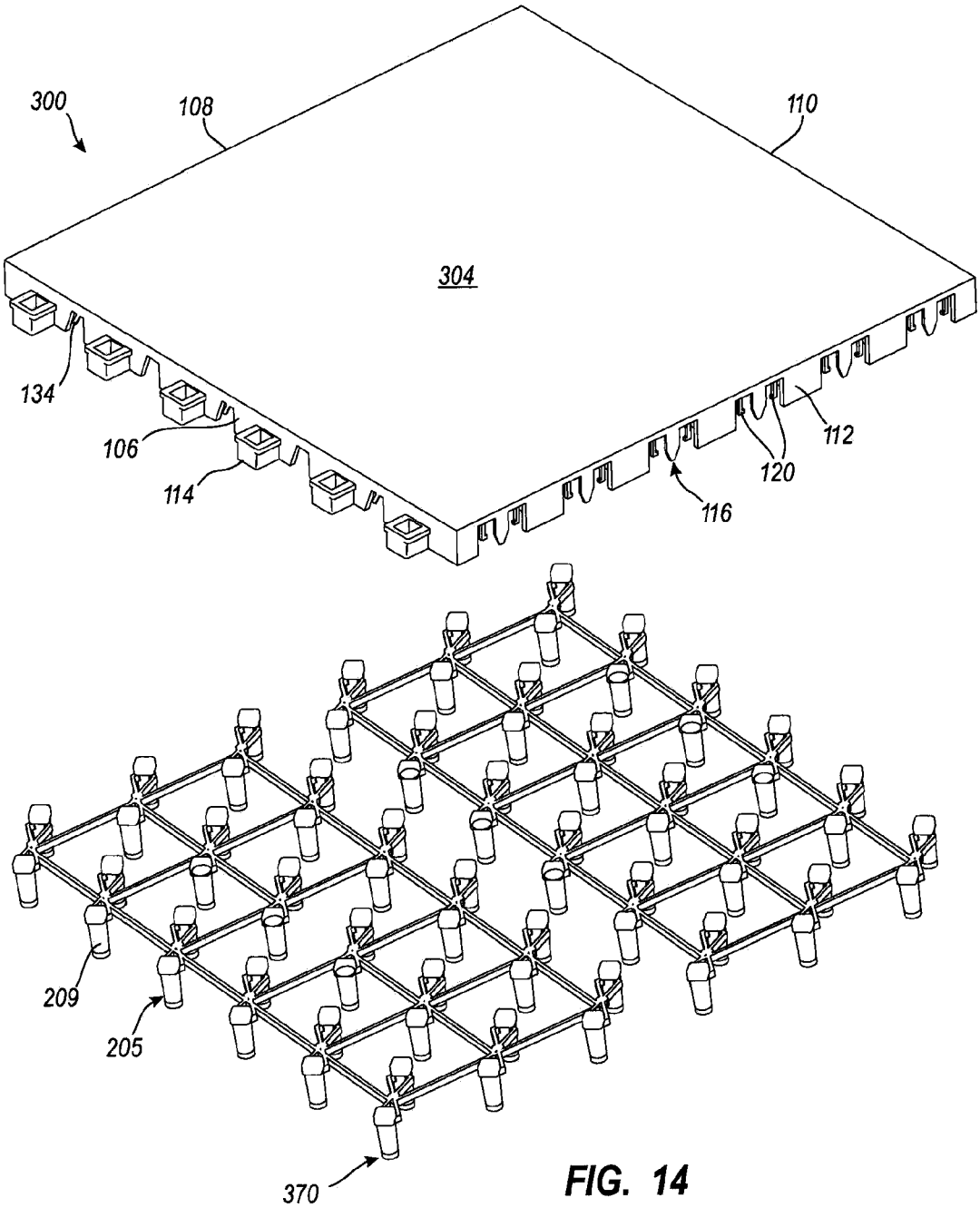
FIG. 14 is an assembly view of a tile with multiple levels of support and a solid top surface according to one embodiment.
Figure 15:
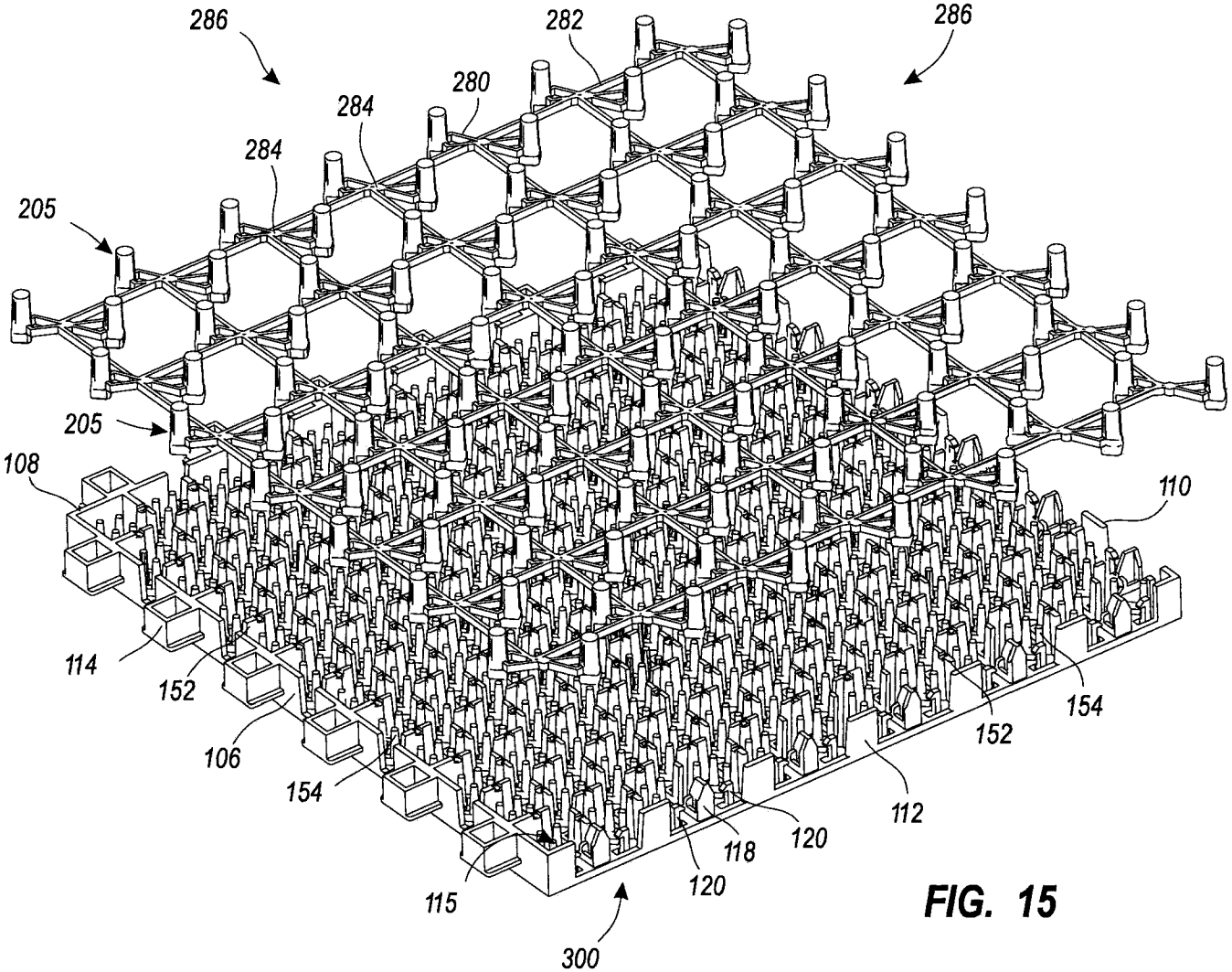
FIG. 15 is a bottom assembly view of a full tile with a solid top surface and multiple interconnected inserts according to one embodiment.

As mentioned above, the full-length inserts 205 comprise a resilient material, which may be an elastomer such as rubber, or they may comprise plastic or other materials. The full-length inserts 205 may include any shape. For example, as shown in FIGS. 12-15, the full-length inserts 205 may comprise a post or compressible column 209. In one embodiment, the full-length inserts 205 may be inserted from the bottom of the modular tile 300. The bottom of the modular floor tile 300 is shown in FIG. 15 and may be similar or identical to the bottom of the floor tile 100 shown in FIGS. 4, 5 and 9. Therefore, according to one embodiment, the full-length inserts 205 may nest in the receivers or holders 115. However, the full length inserts 205 of FIGS. 12-15 may abut an underside of the solid top surface 304, rather than inserting into holes 102 (FIG. 1).

Figure 13:
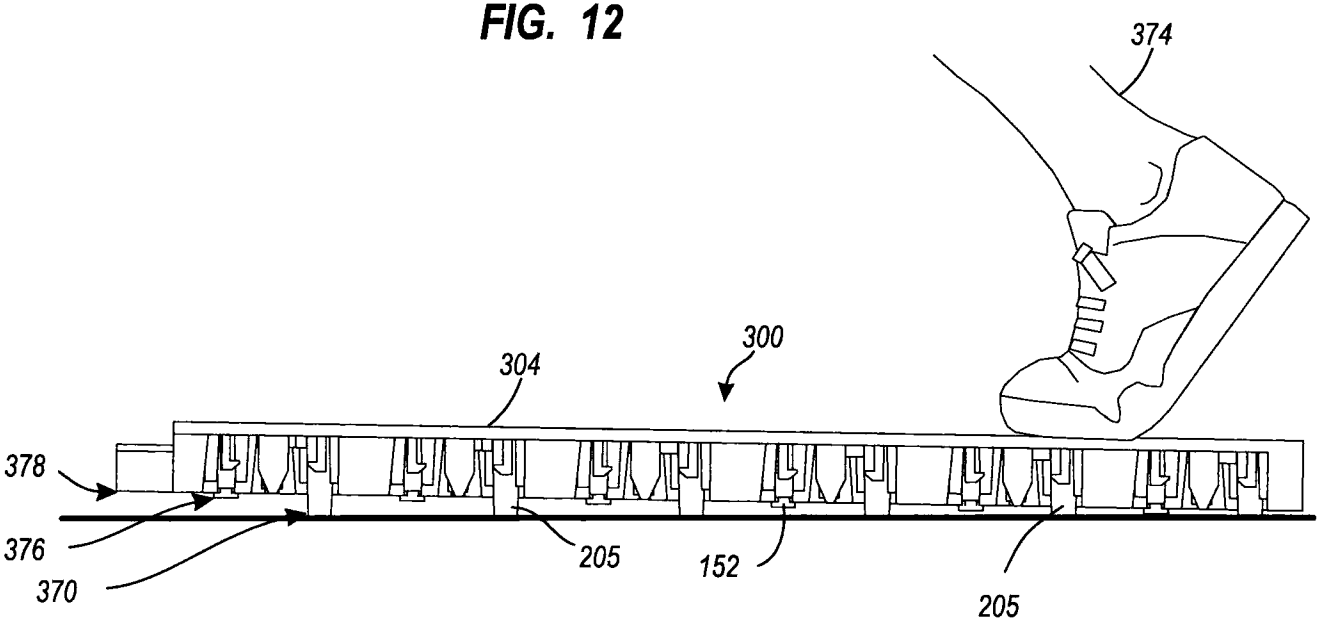
FIG. 13 is a side view of a tile with multiple levels of support under a load according to one embodiment.

The first resilient level 370 of support comprising the plurality of full length inserts 205 tends to comfortably compress under a load as illustrated in FIG. 13. For example, when multiple modular tiles 300 are used to form a sports or dance floor, each step by a user 374 puts a localized load on certain of the full length inserts 205 comprising the first resilient level 370. The full length inserts 205 tend to compress under a load as shown in FIG. 13, providing a forgiving surface for the user 374. The full length inserts 205 rebound to their original length when the load is removed.

In one embodiment, at least one other of the multiple levels of support comprises a first generally rigid level 376. The first rigid level 376 may comprise the first set of generally rigid primary support legs 152 having the first length. The first rigid level 376 may coincide with the bottom plane 372. The first set of support legs 152 may each comprise the split or fork leg as shown in FIG. 15. Absent a load, only the first resilient level 370 contacts the ground. However, under a sufficient load, the full length inserts 205 compress until one or more of the generally rigid primary support legs 152 of the first rigid level 376 reaches the ground. The first rigid level 376 may support the bulk of the load when the first resilient level 370 compresses.

In some embodiments, the modular floor tile 300 includes another support level. For example, the multiple levels of support may comprise a second generally rigid level 378. The second generally rigid level 378 may comprise the second set of generally rigid support legs 154 having the second length. The second set of support legs 154 may comprise clusters of three or four legs. The second length of the second set of support legs 154 is shorter than the first length of the first set of support legs 152. Therefore, absent a load sufficient to overcome the supporting capability of the first set of generally rigid support legs 152, only the first or second levels 370, 376 contact the ground. In the embodiment of FIGS. 12-15, the full length inserts 205 are nested in one or more of the groups of three or four legs. Although generally rigid, the spacing of the first set of support legs 152 facilitates vertical flexing or springing of the modular tiles 300 under a sufficient load. As a load is applied to one or more of the modular tiles 300 via the top surface 304, the full length inserts 205 collapse and the first set of generally rigid support legs 152 contact the ground. Additional loads cause the top surface 304 or the support legs 152 to "give" or flex until the second set of support legs 154 (comprising the second rigid level 378 of support) contacts the ground. The first set of support legs 152 and/or the top surface 304 only flex elastically before the second set of support legs 154 contact the ground. Therefore, the support levels 370, 376, 378 and the modular tile 300 all tend to rebound to an original shape when loads are removed.

Accordingly, application of the principles described herein may result in another especially comfortable spring-like modular floor with multiple layers of support. In one embodiment, there are at least three separate layers of support, but there may be as few as two and as many as four or more. It will be understood that the top surface 304 need not be solid as shown in FIG. 14 to enable the multiple levels of support. There may also be holes in the top surface 304 in some embodiments (e.g., FIGS. 7 and 11).

As discussed above, the full length inserts 205 may be removably inserted into the modular tile 300. In some embodiments, however, the full length inserts 205 or another resilient support level are part of a one-piece, unitary tile.

Figure 16:
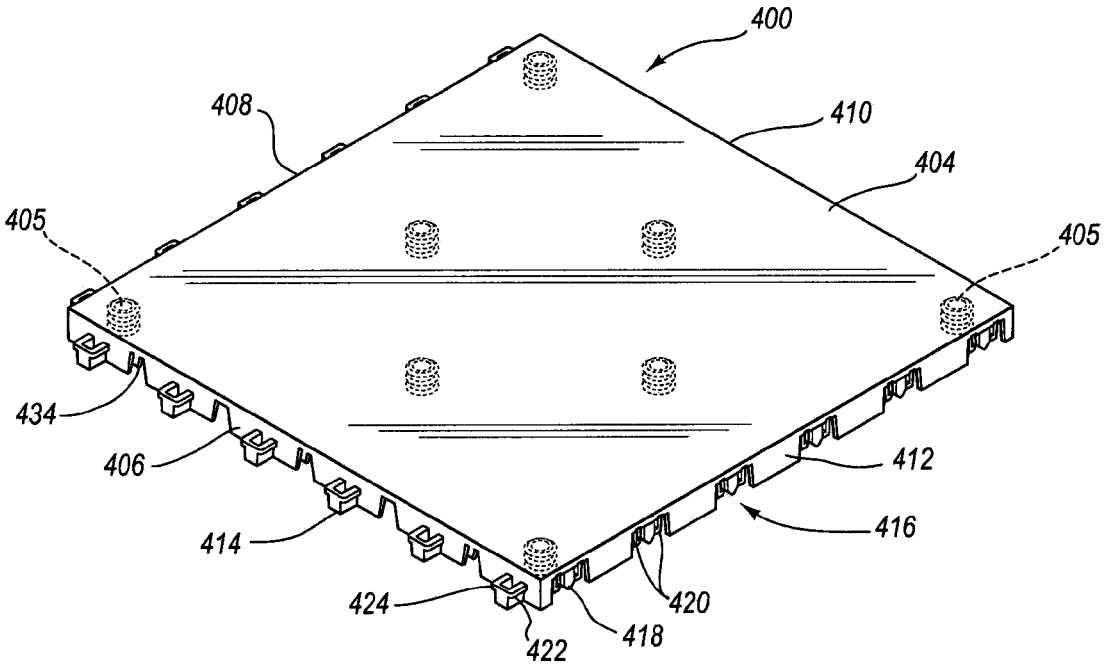
FIG. 16 is a perspective top view of a modular tile according to at least one embodiment.
Figure 17:
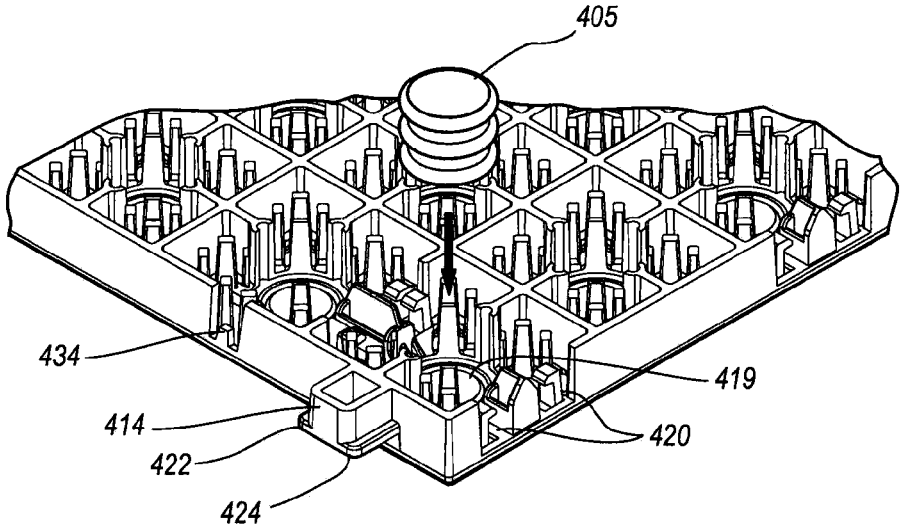
FIG. 17 is a perspective partial bottom view of a modular tile according to at least one embodiment.

FIGS. 16 and 17 illustrate a modular floor tile 400 according to at least one embodiment. As illustrated in these figures, modular floor tile 400 may comprise a tile top surface 404. Top surface layer 404 may comprise a solid top surface. According to additional embodiments, top surface layer 404 may comprise one or more holes. Modular floor tile 400 may additionally comprise a plurality of side edges, including four edge surfaces 406, 408, 410, and 412. At least one of the side edges of modular floor tile 400 may include a plurality of loops 414. For example, as illustrated in FIGS. 16 and 17, a plurality of loops 414 may be disposed on each of the first and second adjacent side surfaces 406, 408. Loops 414 may be spaced along the first and second side surfaces 406, 408 at substantially equal intervals. In at least one embodiment, loops 414 may be disposed along first and second side surfaces 406, 408 at varying intervals. Each of the loops 414 may comprise a rim or lip, which may include first and second lips 422, 424 protruding from sides of the loops 414 (see also FIGS. 1-3).

Each of the plurality of loops 414 may be receptive of a mating locking tab assembly 416 from an adjacent modular floor tile. According to the embodiments of FIGS. 16 and 17, each of the third and fourth adjacent side surfaces 410, 412 may include a plurality of locking tab assemblies 416. According to certain embodiments, modular floor tile 400 may include an equal number of locking tab assemblies 416 and loops 414. Moreover, the locking tab assemblies 416 may be spaced at the same intervals as loops 414. According to various embodiments, each of locking tab assemblies 418 may comprise a center post 418 and flanking hooks 420. As adjacent modular floor tiles 400 are locked together (see, e.g., FIG. 7), a center post 418 may be inserted into an associated loop 414, and flanking hooks 420 may flex around and snap-fit over associated lips 422, 424. Once snapped over lips 422, 424, flanking hooks 420 may resist disconnection of adjacent modular floor tiles 400, while permitting a certain amount of sliding lateral displacement between adjacent modular floor tiles 400.

According to certain embodiments, adjacent modular floor tiles 400 may be biased or spring loaded to a specific, generally equal spacing. For example, one or more of the side walls 406, 408, 410, and 412 may include one or more biasing members such as spring fingers 434 disposed therein. Spring fingers 434 may tend to bear against adjacent side walls of adjacent modular floor tiles 400, aligning modular floor tiles in a floor to a substantially equal spacing, while also permitting lateral displacement upon the application of a sufficient lateral force.

Each of modular floor tiles 400 may include a support system under top surface layer 404. According to various embodiments, the support system may comprise a multiple-tier suspension system. According to additional embodiments, modular floor tile 400 may comprise one or more inserts or resilient support members 405 forming a first resilient level. Resilient support members 405 may comprise a resilient material, which may be an elastomer such as rubber, silicone, a polymer, and/or any other suitable elastomeric material and may include many different shapes. Additionally, resilient support member 405 may be compressible under various forces, including various forces applied to top surface layer 404.

Figure 21:
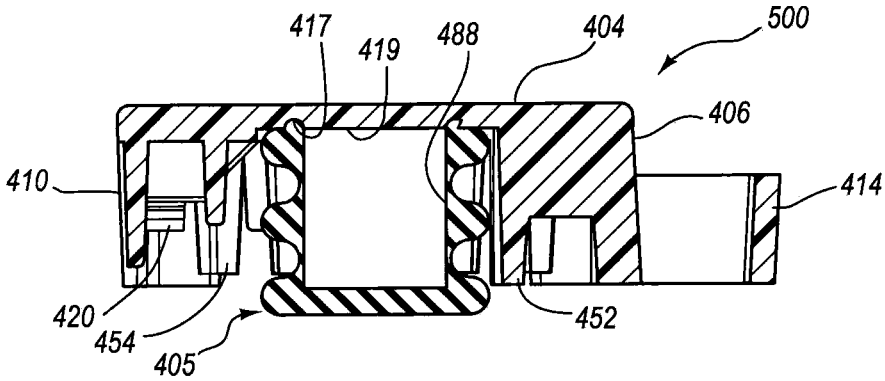
FIG. 21 is a cross-sectional side view of a modular tile according to at least one embodiment.

Each of resilient support members 405 may be substantially equal in length to, or slightly longer than, the edge surfaces 406, 408, 410 and/or 412 (see also, FIG. 21). In additional embodiments, resilient support members 405, when assembled in the modular floor tile 400, may extend beyond a bottom plane parallel to and spaced from the top surface 404. Accordingly, resilient support members 405 may extend beyond edge surfaces 406, 408, 410 and/or 412, contacting a ground surface or other support surface.

The first resilient level of support, which includes a plurality of resilient support members 405, may comfortably compress under a load (see, e.g., FIG. 13). For example, when multiple modular floor tiles 400 are used to form a sports or dance floor, each step by a user may put a localized load on certain of the resilient support members 405 forming the first resilient level. The resilient support members 405 may compress under a load, providing a forgiving surface for a user. The resilient support members 405 may rebound to their original length when the load is removed. Accordingly, modular floor tiles 400 that include resilient support members 405 may form a more user-friendly playing surface that provides added comfort and protection to a user while reducing a risk of injury to the user.

Additionally, resilient support members 405 may frictionally engage a ground surface or other suitable surface, preventing and/or reducing movement of one or more modular floor tiles 400. Resilient support members 405 may be formed from various materials suitable for increasing the traction of modular floor tiles 400 relative to various ground or other surfaces. Additionally, resilient support members 405 may be configured to provide additional traction in wet and/or dry condition.

Moreover, resilient support members 405 may be configured such that they are removably secured to modular floor tiles 400. Accordingly, resilient support member 405 may enable relatively easy and cost efficient repair of modular floor tiles 400. For example, resilient support members 405 may be easily removed and replaced in existing sports courts or other surfaces comprising modular floor tiles 400. Additionally, the removable and/or replaceable resilient support members may enable relatively easy and cost efficient customization of modular floor tiles 400. For example, various types of modular floor tiles 400 having various characteristics, such as varying traction and resiliency, may be provided by merely providing resilient support members 405 in modular floor tiles 400 having varying characteristic.

Further, resilient support members 405 may provide modular floor tiles 400 with noise dampening characteristics. For example, resilient support members 405 may prevent relatively rigid portions of modular floor tiles 400 from contacting a ground surface or other surface under modular floor tiles 400. In additional embodiments, resilient support members 405 may reduce excessive noise by slowing the rate at which a portion of a modular floor tile 400 approaches a ground surface or other surface under the tile, thereby lessening the impact force with which modular floor tile 400 contacts the ground surface or other surface.

The spacing of primary and/or secondary support legs positioned under top surface layer 404 (see, e.g., first set of support legs 152 and second set of support legs 154 in FIGS. 3-5) may facilitate vertical flexing or springing of each of modular floor tiles 400. That is to say, as a load is applied to one or more of modular floor tiles 400 on the top surface layer 404, the top surface layer may "give" or tend to flex somewhat, until a secondary set of support legs under top surface layer 404 contacts the ground. This may provide further dampening characteristics to modular floor tiles 400. In addition, as mentioned above, resilient support members 405 disposed under top surface layer 404 may tend to compress as they are stepped on.

FIGS. 18-21 illustrate an exemplary modular floor tile 500 according to additional embodiments. Modular floor tile 500 is similar in many respects to modular floor tile 400, as illustrated in these figures. However, modular floor tile 500 may be smaller in length and width than modular floor tile 400. Modular floor tile 500 may comprise a top surface layer 404 (see, e.g., FIG. 16). Additionally, modular floor tile 500 may include one or more center posts 418, flanking hooks 420, and/or loops 414.

Each of the modular floor tiles 500 may include a support system under the top surface layer 404. According to some aspects, the support system may comprise a multiple-tier suspension system, such as a two-tier suspension system (see, e.g., two-tier suspension system 150 in FIGS. 3-5). A two-tier suspension system may comprise a plurality of support legs or protrusions extending down from top surface layer 404. The plurality of support legs may comprise a first set of generally rigid primary support legs 452 or protrusions having a first length, and a second set of generally rigid support legs 454 or protrusions having a second length. The length of the second set of support legs 454 may be shorter than the length of the first set of support legs 452. Therefore, absent a load, the first set of support legs 452 may contact the ground while the second set of the support legs 454 may be spaced from the ground. The first and second sets of support legs 452, 454 may be also be arranged in an alternating pattern.

Figure 18:
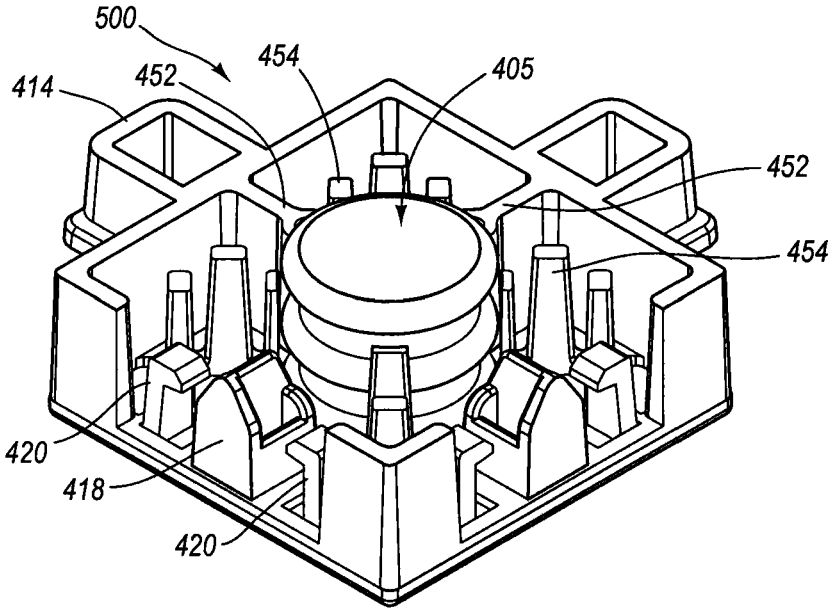
FIG. 18 is a perspective bottom view of a modular tile according to at least one embodiment.
Figure 19:
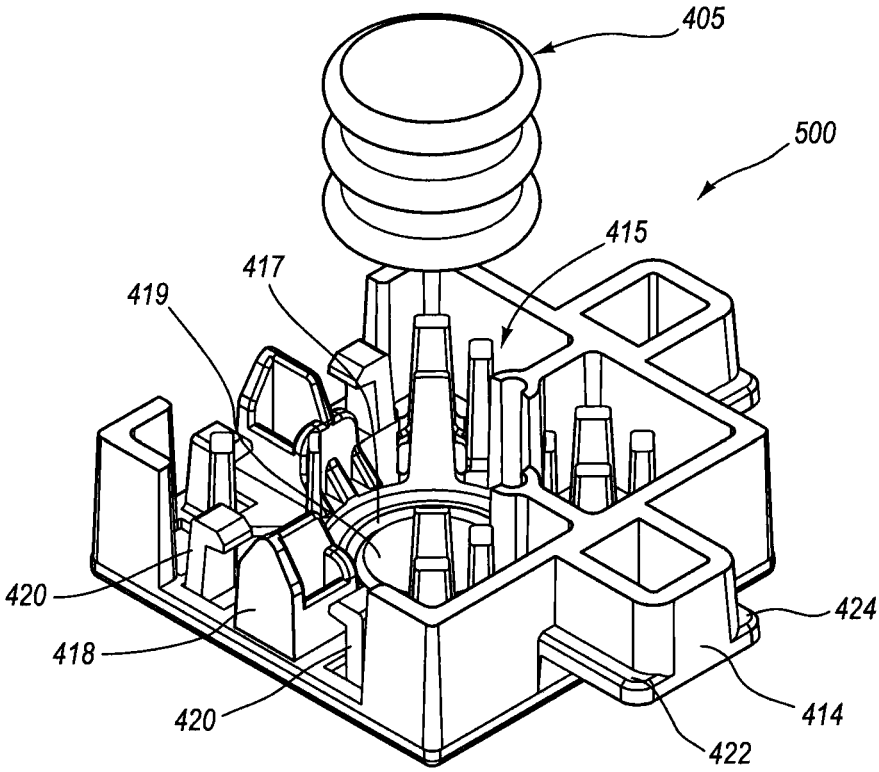
FIG. 19 is a perspective bottom assembly view of a modular tile according to at least one embodiment.
Figure 20:
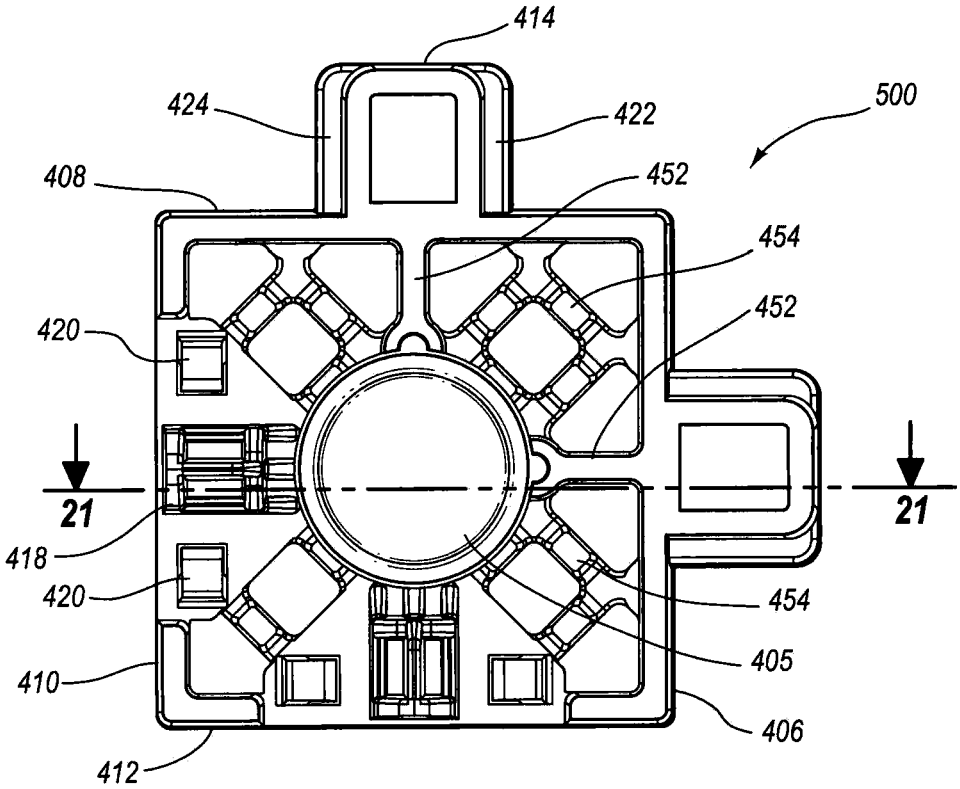
FIG. 20 is a bottom view of a modular tile according to at least one embodiment.

According to at least one embodiment, resilient support members 405 may be nested in a group of three, four, or more support legs 452, 454. According to various embodiments, the first set of support legs 452 and/or the second set of support legs 454 may comprise a receiver 415, as illustrated in FIG. 19. An exterior portion of resilient support member 405 (e.g., peripheral surface that is arranged generally perpendicular to the top surface layer 404) may be deformed around support legs 452 and/or support legs 454 forming receiver 415, as illustrated in FIG. 18, to retain the support legs 452. By forcing the resilient support member 405 into receiver 415 formed by a cluster of three, four, or more support legs 452 and/or support legs 454, resilient support member 405 may bear against support legs 452 and/or support legs 454. As resilient support member 405 bears against support legs 452 and/or support legs 454, resilient support member 405 may be frictionally held within receiver 415.

According to at least one embodiment, as illustrated in FIGS. 19 and 21, modular floor tile 500 (and likewise, modular floor tile 400 shown in FIGS. 16 and 17) may comprise a recess 417 formed in an underside of top surface layer 404. Additionally, modular floor tile 500 may comprise a protrusion 419 extending from an underside of top surface layer 404. Recess 417 and protrusion 419 may comprise shapes complimentary to resilient support member 405. Accordingly, a portion of resilient support member 405 may be seated in recess 417 and/or may surround at least a portion of protrusion 419. Additionally, resilient support member 405 may be more firmly secured to an underside of top surface layer 404 by coupling with recess 417 and/or protrusion 419. Accordingly, recess 417 and/or protrusion 419 may enable resilient support member 405 to be more securely held within receiver 415.

Figure 22:
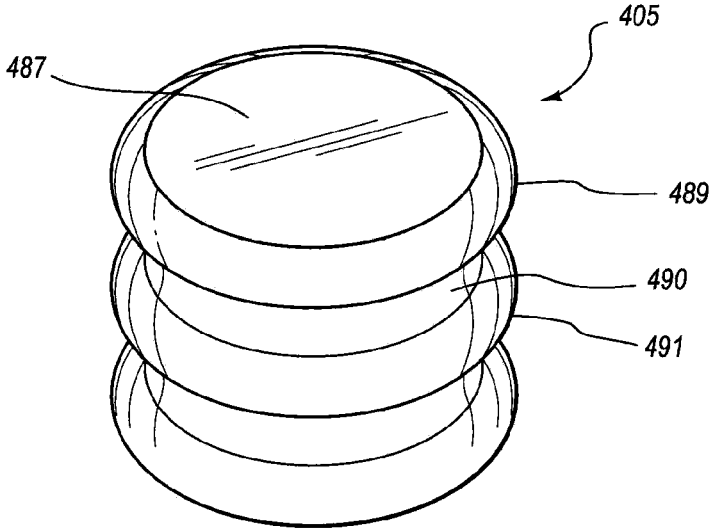
FIG. 22 is a perspective bottom view of a resilient support member according to at least one embodiment.
Figure 23:
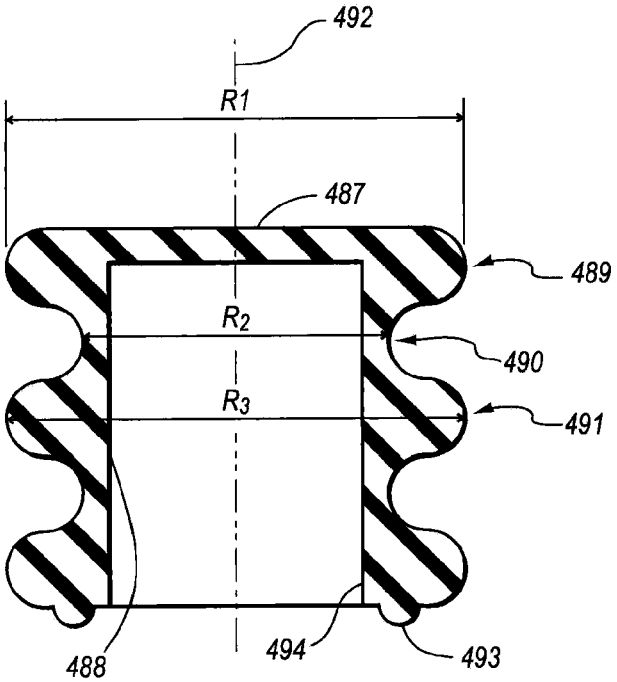
FIG. 23 is a cross-sectional side view of a resilient support member according to at least one embodiment.
Figure 24:
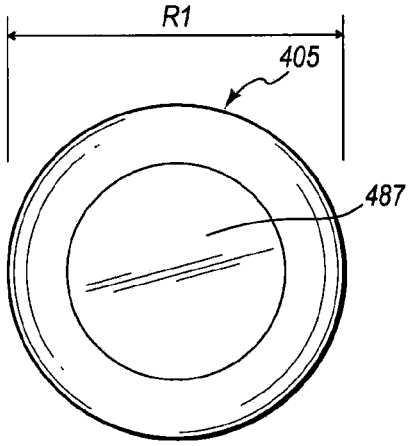
FIG. 24 is a bottom view of a resilient support member according to at least one embodiment.

FIGS. 22-24 illustrate an exemplary resilient support member 405 according to at least one embodiment. As illustrated in these figures, resilient support member 405 may comprise a support member end surface 487, a first perimeter portion 489, a second perimeter portion 490, and a third perimeter portion 491. Additionally, as illustrated in FIG. 23, resilient support member 405 may comprise a support member cavity 488 having a cavity opening 494. In addition, resilient support member 405 may have a support member axis 492 extending longitudinally through a central portion of resilient support member 405. Resilient support member 405 may also comprise a seating portion 493 located at an end portion of support member 405 opposite support member end surface 487.

Support member end surface 487 may be located adjacent to a ground, floor, or other surface when a modular floor tile 400, 500 comprising support member 405 is placed on the ground or floor surface. According to various embodiments, support member end surface 487 may lay substantially flush with an adjacent ground surface when modular floor tile 400, 500 is placed on the ground surface. In additional embodiments, support member end surface 487 may abut and/or conform to a shape of a surface that it faces. In addition, seating portion 493 may be configured such that it is positioned adjacent to an underside of top surface layer 404 when resilient support member 405 is positioned within receiver 415. According to various embodiments, seating portion 493 may have a shape that is complimentary to a shape of a portion of an underside of top surface layer 404, such as, for example, recess 417.

As illustrated in FIGS. 22 and 23, resilient support member 405 may have a generally undulating surface. For example, resilient support member 405 may be formed to a generally elongated and/or cylindrical shape having an undulating surface, wherein a diameter of a surface of resilient support member 405 varies at different points along the support member surface respective to support member axis 492. For example, as shown in FIGS. 22 and 23, resilient support member 405 may comprise a first perimeter portion 489, a second perimeter portion 490, and a third perimeter portion 491. First perimeter portion 489 may be longitudinally adjacent to second perimeter portion 490, and similarly, second perimeter portion 490 may be adjacent to third perimeter portion 491. Resilient support member 405 may also comprise additional perimeter portions of varying diameters.

For example, as illustrated in FIG. 23, first perimeter portion 489 may extend to a first diameter or radial distance $R_1$ respective to support member axis 492. First diameter $R_1$ is also illustrated in the top view shown in FIG. 24. Second perimeter portion 490 may extend to a second diameter or radial distance $R_2$ respective to support member axis 492. Additionally, third perimeter portion 490 may extend to a third diameter or radial distance $R_3$ respective to support member axis 492. According to various embodiments, first diameter $R_1$ and third diameter $R_3$ may be larger than second diameter $R_2$. According to certain embodiments first diameter $R_1$ and third diameter $R_3$ may be substantially the same. First diameter $R_1$ and third diameter $R_3$ may also be different.

Resilient support member 405 may also include one or more perimeter portions in addition first perimeter portion 489, second perimeter portion 490, and third perimeter portion 491. Additional perimeter portions may extend to varying diameters or radial distances respective to support member axis 492. Additional perimeter portions may also extend to diameters or radial distances that are the same as or different than first diameter $R_1$, second diameter $R_2$, and/or third diameter $R_3$. An undulating shape of resilient support member 405, in which first perimeter portion 489, second perimeter portion 490, third perimeter portion 491, and/or additional perimeter portions are formed to varying diameters or radial distances respective to support member axis 492, may facilitate compression and/or rebound of resilient support member 405 in response to a force. For example, the undulating shape of resilient support member 405 described above may enable more stable compression and/or rebound of resilient support member 405 in response to various forces acting on modular floor tile 400, 500. The undulating shape of resilient support member 405 may also facilitate securement of resilient support member in modular floor tile 400, 500, such as, for example, in receiver 415 as described above. The undulating shape may additionally enable greater compressibility of resilient support member 405 and/or may enable greater customizability of resilient support member 405 to suit various sport court requirements.

As additionally shown in FIG. 23, a support member cavity 488 may be defined within resilient support member 405. Support member cavity 488 may be formed within resilient support member 405 to varying shapes and depths. For example, as illustrated in FIG. 23, support member cavity 488 may comprise a substantially cylindrical shape. Support member cavity 488 may also be formed to any suitable shape or depth. In at least one embodiment, support member cavity 488 may be formed such that it follows a general shape of an outer surface of resilient support member 405. According to additional embodiments, a support member cavity 488 may not be defined within resilient support member 405.

According to at least one embodiment, support member cavity 488 and/or cavity opening 494 may be configured to help seat and/or couple resilient support member 405 to an underside of top surface layer 404. For example, cavity opening 494 of support member cavity 488 may be formed to a shape that is complementary to protrusion 419 and/or recess 417 in the underside of top surface layer 404 (see, e.g., FIGS. 19 and 21). Additionally, cavity opening 494 of support member cavity 488 may be formed to surround and/or engage protrusion 419, frictionally seating and/or securing resilient support member 405 to protrusion 419. Protrusion 419 may extend to varying distances from top surface layer 404.

Figure 25:
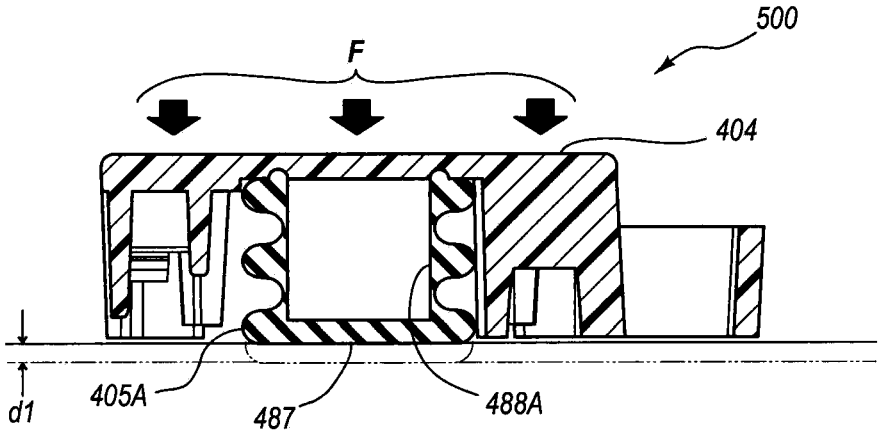
FIG. 25 is a cross-sectional side view of a modular tile according to at least one embodiment.
Figure 26:
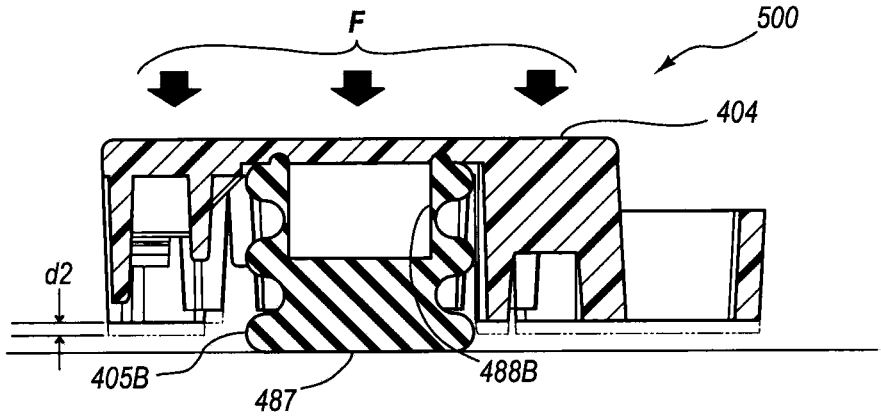
FIG. 26 is a cross-sectional side view of a modular tile according to at least one embodiment.
Figure 27:
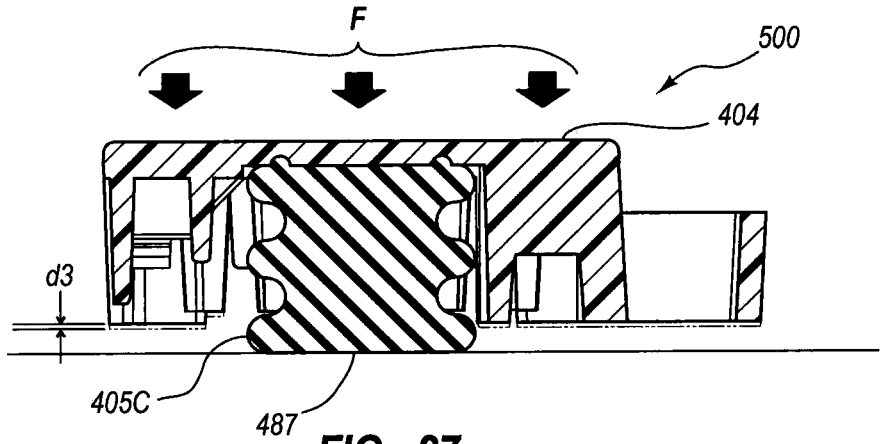
FIG. 27 is a cross-sectional side view of a modular tile according to at least one embodiment.

Additionally, as illustrated in FIGS. 25-27, support member cavity 488 may be formed to varying shapes and depths within resilient support member 405 in order to vary the compressibility and/or resilience of resilient support member 405. For example, a resilient support member 405 having a relatively larger and/or deeper support member cavity 488 may be more compressible in response to a force than a resilient support member 405 having a relatively smaller and/or shallower support member cavity 488.

FIG. 25 illustrates a modular floor tile 500 comprising a resilient support member 405A having a relatively larger and/or deeper support member cavity 488A. Modular floor tile 500 may be positioned on a ground surface such that support member end surface 487 abuts the ground surface. As shown in FIG. 25, a force F applied to top surface layer 404 may compress resilient support member 405A against the ground surface such that top surface layer 404 (and likewise edge surface extending from top surface layer 404) moves a distance $d_1$ towards the ground surface.

FIG. 26 illustrates a modular floor tile 500 comprising a resilient support member 405B having a relatively smaller and/or shallower support member cavity 488B. Modular floor tile 500 may be positioned on a ground surface such that support member end surface 487 abuts the ground surface. As shown in FIG. 26, a force F applied to top surface layer 404 may compress resilient support member 405B against the ground surface such that top surface layer 404 moves a distance $d_2$ towards the ground surface. Distance $d_2$ may be less the distance $d_1$ due to the lower resilience and/or compressibility of resilient support member 405B comprising support member cavity 488B in comparison resilient support member 405A comprising support member cavity 488A.

FIG. 27 illustrates a modular floor tile 500 comprising a resilient support member 405C that does not have a support member cavity. Modular floor tile 500 may be positioned on a ground surface such that support member end surface 487 abuts the ground surface. As shown in FIG. 27, a force F applied to top surface layer 404 may compress resilient support member 405C against the ground surface such that top surface layer 404 moves a distance $d_3$ towards the ground surface. Distance $d_3$ may be less the distance $d_1$ and distance $d_2$ due to the lower resilience and/or compressibility of resilient support member 405C in comparison with resilient support member 405A comprising support member cavity 488A and in comparison with resilient support member 405B comprising support member cavity 488B.

Figure 28:
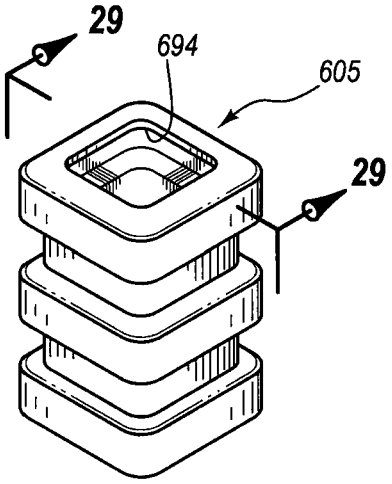
FIG. 28 is a perspective top view of a resilient support member according to at least one embodiment.
Figure 29:
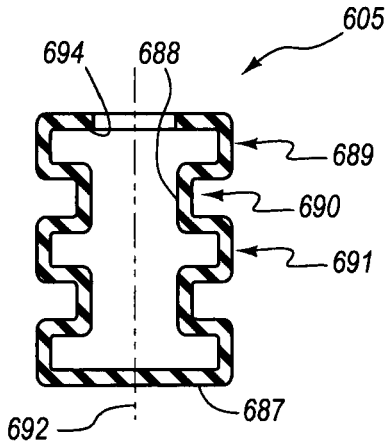
FIG. 29 is a cross-sectional side view of a resilient support member according to at least one embodiment.

FIGS. 28-31 illustrate support members having various suitable shapes and configurations. For example, as shown in FIGS. 28 and 29, resilient support member 605 may comprise a support member end surface 687, a first perimeter portion 689, a second perimeter portion 690, and a third perimeter portion 691. Additionally, resilient support member 605 may comprise a support member cavity 688 having a cavity opening 694. In addition, resilient support member 605 may have a support member axis 692 extending longitudinally through a central portion of resilient support member 605. Resilient support member 605 may also comprise a seating portion (see, e.g., seating portion 493 in FIG. 23) located at an end portion of support member 605 opposite support member end surface 687.

Resilient support member 605 may also have a generally undulating surface. For example, resilient support member 605 may be formed to a generally elongated shape having an undulating surface, wherein a radial distance of a surface of resilient support member 605 relative to support member axis 692 varies at different points along the support member surface respective to support member axis 692. In addition, resilient support member 605 may have one or more substantially rectangular shaped perimeter portions. For example, first perimeter portion 689, second perimeter portion 690, and/or third perimeter portion 691 may each be substantially rectangular and/or square in shape.

Figure 30:
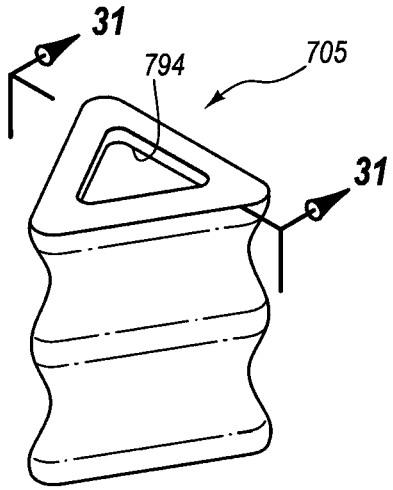
FIG. 30 is a perspective top view of a resilient support member according to at least one embodiment.
Figure 31:
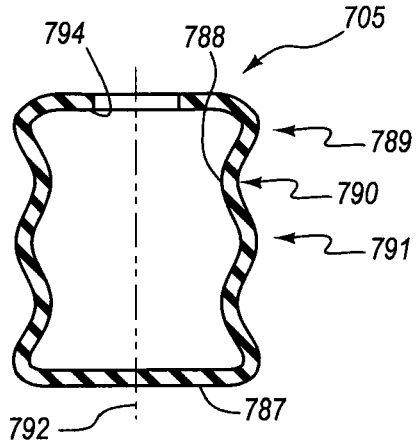
FIG. 31 is a cross-sectional side view of a resilient support member according to at least one embodiment.

According to additional embodiments, as illustrated in FIGS. 30 and 31, resilient support member 705 may comprise a support member end surface 787, a first perimeter portion 789, a second perimeter portion 790, and a third perimeter portion 791. Additionally, resilient support member 705 may comprise a support member cavity 788 having a cavity opening 794. In addition, resilient support member 705 may have a support member axis 792 extending longitudinally through a central portion of resilient support member 705. Resilient support member 705 may also comprise a seating portion (see, e.g., seating portion 493 in FIG. 23) located at an end portion of support member 705 opposite support member end surface 787.

Resilient support member 705 may also have a generally undulating surface. For example, resilient support member 705 may be formed to a generally elongated shape having an undulating surface, wherein a radial distance of a surface of resilient support member 705 relative to support member axis 792 varies at different points along the support member surface respective to support member axis 792. In addition, resilient support member 705 may have one or more substantially triangular shaped perimeter portions. For example, first perimeter portion 789, second perimeter portion 790, and/or third perimeter portion 791 may each be substantially triangular in shape.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A floor tile system, comprising:

a tile component, comprising:

an upward facing surface;

a plurality of first rigid supports defining a downward facing surface;

a plurality of resilient support members extending away downward from the upward facing surface and being disposed entirely below the upward facing surface and extending further downward than the downward facing surface when in an uncompressed position, wherein the plurality of resilient support members are compressible against a support surface upon which the floor tile system rests until the first rigid support members defining the downward facing surface directly adjacent to the plurality of resilient support members also contact the support surface.

2. The floor tile system of claim 1, wherein the plurality of first rigid supports extend in a direction opposite the upward facing surface.

3. The floor tile system of claim 1, wherein the upward facing surface and the plurality of first rigid supports are formed integrally as a single piece.

4. The floor tile system of claim 1, wherein the plurality of resilient support members are mounted to the plurality of first rigid supports.

5. The floor tile system of claim 4, wherein the plurality of resilient support members are detachable from the plurality of first rigid supports.

6. The floor tile system of claim 1, wherein the plurality of resilient support members each comprises an elongate portion.

7. The floor tile system of claim 1, further comprising a plurality of second rigid supports extending downward a distance less than the plurality of first rigid supports.

8. The floor tile system of claim 1, wherein the upward facing surface comprises an open surface having a plurality of openings formed therein.

9. A modular floor tile component, comprising:

an upward facing surface;

a first rigid level extending downward relative to the upward facing surface;

a plurality of resilient support members extending downward from and disposed entirely under the upward facing surface, the plurality of resilient support members being compressible toward the upward facing surface upon application of a downward directed load to the modular floor tile component at least until receding to a plane defined by a lowest portion of the first rigid level, the plurality of resilient support members extending further downward than the first rigid level and having an outer peripheral surface arranged perpendicular to the top surface layer, the plurality of resilient support members being retained by contact with the first rigid level along the outer peripheral surface.

10. The modular floor tile component of claim 9, wherein the first rigid level includes a plurality of rigid support members extending downward relative to the upward facing surface.

11. The modular floor tile component of claim 9, further comprising a second rigid support level extending downward relative to the upward facing surface a distance less than the first rigid support level.

12. The modular floor tile component of claim 9, wherein the at least one resilient support member comprises an elastomeric material.

13. The modular floor tile component of claim 9, wherein the resilient support members are compressible until the first rigid support level contacts a support surface upon which the modular floor tile component rests.

14. The modular floor tile component of claim 9, wherein the upward facing surface and the first rigid support level are integrally formed as a single piece.

15. A floor tile system, comprising:

a modular member having a top surface layer and a bottom surface layer, the top surface layer comprising an upward facing surface, the bottom surface layer comprising a plurality of first rigid members defining a downward facing surface plane;

a plurality of resilient support members extending downward from and disposed entirely under the top surface layer and extending to a distance downward further than the first rigid members, wherein the plurality of resilient support members are compressible toward the top surface layer at least until receding to the downward facing surface plane.

16. The floor tile system of claim 15, wherein the top surface layer and the bottom surface layer are formed integrally as a single piece.

17. The floor tile system of claim 15, wherein the plurality of resilient support members are detachably mounted to the modular member.

18. The floor tile system of claim 15, wherein the plurality of resilient support members are compressible until the downward facing surface contacts a support surface upon which the floor tile system rests.

19. The floor tile system of claim 15, wherein the modular member further comprises a plurality of second rigid members extending downward a distance less than the plurality of first rigid members.

20. The floor tile system of claim 15, wherein the plurality of resilient support members are retained on the modular member by contact with the plurality of first rigid members.

21. The floor tile system of claim 15, wherein the bottom surface layer includes a plurality of recesses, and the resilient support members include a plurality of protrusions, the protrusions sized and oriented for seating in the recesses, the protrusions being secured by the recesses.

22. The floor tile system of claim 1, wherein the downward facing surface includes a plurality of recesses, and the resilient support members include a plurality of protrusions, the protrusions sized and oriented for seating in the recesses, the protrusions being secured by the recesses.

23. The modular floor tile component of claim 9, wherein the resilient support members are compressed against an underside of the upward facing surface, the underside having a plurality of recesses, and the resilient support members having a plurality of protrusions, the protrusions sized and oriented for seating in the recesses, the protrusions being secured by the recesses.

24. A floor tile system, comprising:

a tile component, comprising:

an upward facing surface;

a plurality of first rigid supports defining a downward facing surface;

a plurality of resilient support members extending away from the upward facing surface and being disposed entirely below the upward facing surface and extending further downward than the downward facing surface when in an uncompressed position, wherein the plurality of resilient support members are compressible against a support surface upon which the floor tile system rests until the downward facing surface also contacts the support surface;

wherein the downward facing surface includes a plurality of recesses, and the resilient support members include a plurality of protrusions, the protrusions sized and oriented for seating in the recesses, the protrusions being secured by the recesses.

25. A floor tile system, comprising:

a modular member having a top surface layer and a bottom surface layer, the top surface layer comprising an upward facing surface, the bottom surface layer comprising a plurality of first rigid members defining a downward facing surface plane;

a plurality of resilient support members disposed entirely under the top surface layer and extending to a distance downward further than the first rigid members, wherein the plurality of resilient support members are compressible toward the top surface layer at least until receding to the downward facing surface plane;

wherein the bottom surface layer includes a plurality of recesses, and the resilient support members include a plurality of protrusions, the protrusions sized and oriented for seating in the recesses, the protrusions being secured by the recesses.

* * * * *